US005589738A

United States Patent [19]

Onodaka et al.

[11] Patent Number: 5,589,738

[45] Date of Patent: Dec. 31, 1996

[54] FIELD EMISSION TYPE DISPLAY DEVICE

[75] Inventors: Koji Onodaka; Katsuya Hiraga; Yoichi Kobori; Hiroshi Sakurada; Teruo Watanabe; Shigeo Itoh, all of Mobara, Japan

[73] Assignee: Futaba Denshi Kogyo Kabushiki Kaisha, Mobara, Japan

[21] Appl. No.: 361,582

[22] Filed: Dec. 22, 1994

Related U.S. Application Data

[63] Continuation of Ser. No. 359,827, Dec. 20, 1994.

[30] Foreign Application Priority Data

Dec. 20, 1993 [JP] Japan ..... 5-344482
Dec. 22, 1993 [JP] Japan ..... 5-345610
Dec. 22, 1993 [JP] Japan ..... 5-345612

[51] Int. Cl.[6] ..... G09G 3/10

[52] U.S. Cl. ..... 315/169.1; 315/169.3; 315/167; 315/350; 315/351

[58] Field of Search ..... 315/169.3, 169.1, 315/167, 350, 351; 340/781, 766

[56] References Cited

U.S. PATENT DOCUMENTS 5,300,862 4/1994 Parker et al. ..... 315/169.3
5,404,081 4/1995 Kane et al. ..... 315/169.3

OTHER PUBLICATIONS

U.S. Ser. No. 08/361,582, Dec. 22, 1994, Pending.
U.S. Ser. No. 08/473,779, Jun. 6, 1995, Pending.

*Primary Examiner*—Frank Gonzalez
*Assistant Examiner*—Reginald A. Ratliff
*Attorney, Agent, or Firm*—Oblon, Spivak, McClelland, Maier & Neustadt, P.C.

[57] ABSTRACT

A field emission type display device capable of providing display with gradation and permitting the whole display device to be integrated with a display drive circuit section. Memory sections are arranged in correspondence to image cell sections, resulting in static display being accomplished. Also, Light emission of an anode is carried out depending on data held in the memory section, so that a luminous period is increased and adequate luminance is provided at a drive voltage substantially lower than that required for dynamic display. An FEC element is incorporated in each of the memory sections in correspondence to incorporation of an FEC element in each of the image cell sections, so that the image cell sections and memory sections may be concurrently manufactured during manufacturing of the FEC elements, to thereby significantly simplify manufacturing of display device.

7 Claims, 23 Drawing Sheets

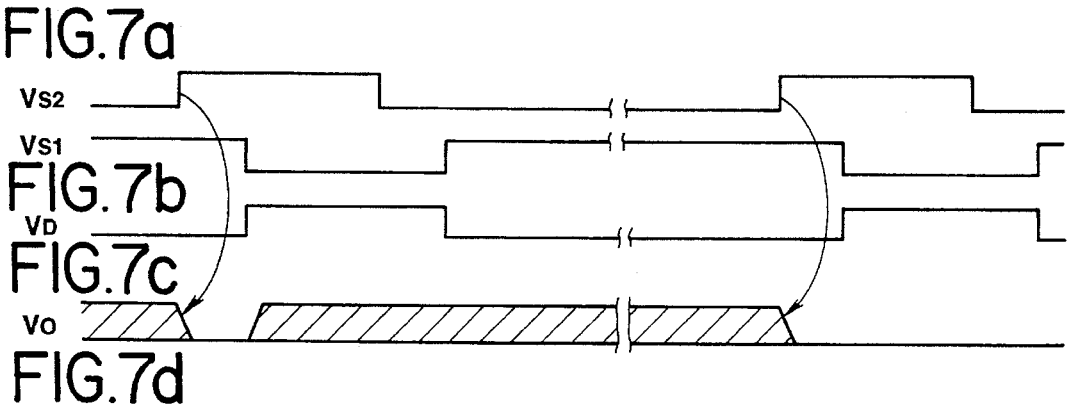
FIG.8
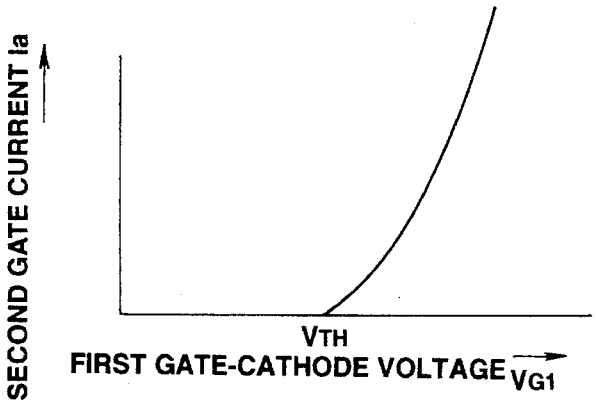

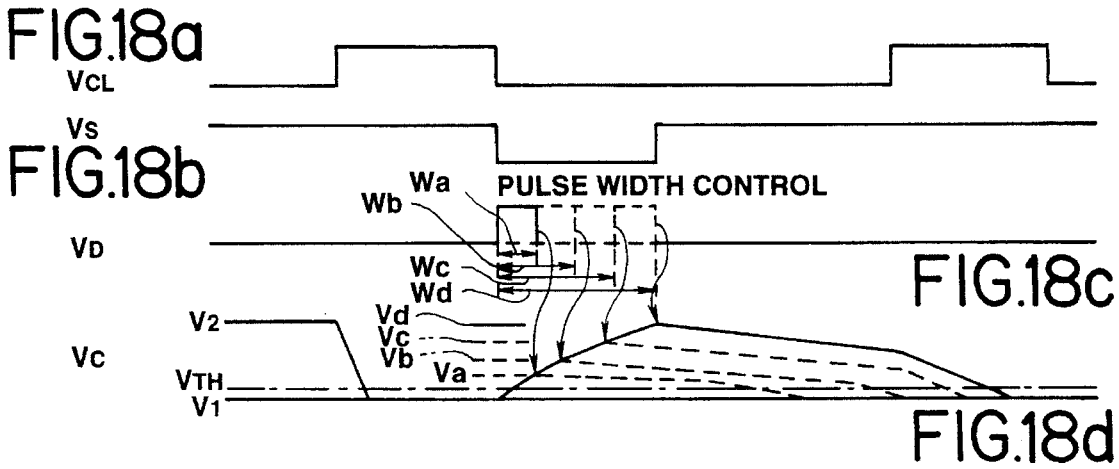
FIG.19(a)
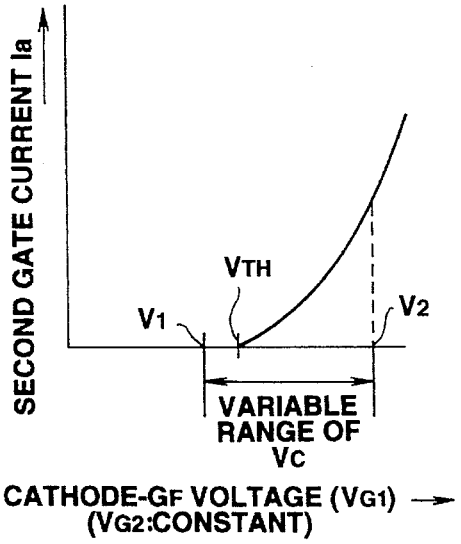
FIG.19(b)
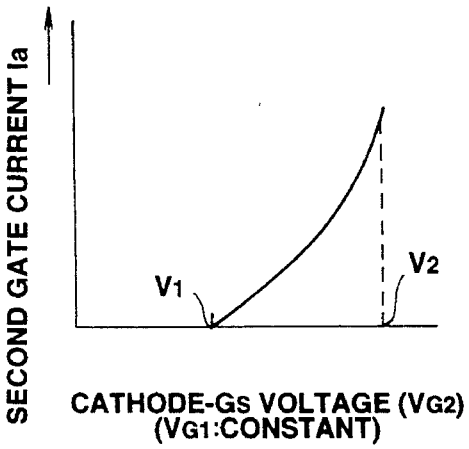

FIG.20(a)
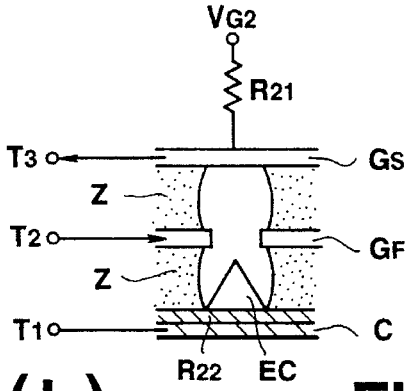
FIG.20(b)
T1 : GND
| T2 INPUT | T3 OUTPUT |
|---|---|
| L | H |
| H | L |
FIG.20(c)
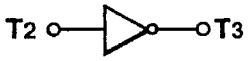
FIG.21(a)
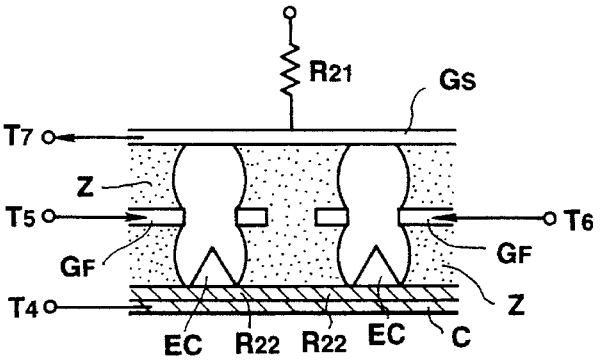
FIG.21(b)
T4 : GND
| T5 INPUT | T6 INPUT | T7 OUTPUT |
|---|---|---|
| L | L | H |
| L | H | L |
| H | L | L |
| H | H | L |
FIG.21(c)
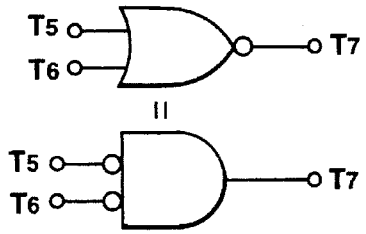
FIG.22
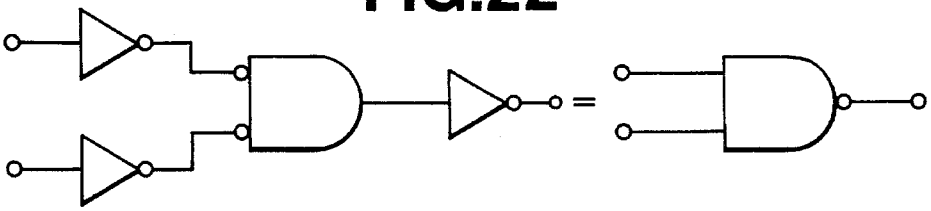

FIELD EMISSION TYPE DISPLAY DEVICE

This application is a Continuation of Ser. No. 08/359,827 filed Dec. 20, 1994.

BACKGROUND OF THE INVENTION

This invention relates to a field emission type display device having field emission cathodes incorporated therein, and more particularly to an improvement in a display device wherein the whole device including peripheral equipments is integrally constructed while having field emission cathodes known as a cold cathode incorporated therein.

It has been wide known that when an electric field applied to a surface of a metal material or that of a semiconductor material is set is to be about $10^9$ (V/m), a tunnel effect occurs to permit electrons to pass through a barrier, resulting in the electrons being discharged to a vacuum even at a normal temperature. Such a phenomenon is referred to as "field emission" and a cathode constructed so as to emit electrons based on such a principle is referred to as "field emission cathode" (hereinafter also referred to as "FEC").

Recent rapid development of semiconductor processing techniques permits a field emission cathode, in particular, of the surface discharge type to be formed of field emission cathode elements of a size as small as microns. A device which is so constructed that a plurality of such FEC elements of the surface discharge type are arranged on a substrate and electrons emitted from emitters of the FEC elements are impinged on phosphors, to thereby cause the phosphors to selectively emit light is expected to be widely used as a main component for various kinds of display devices and electronic devices generally formed into a flat shape.

The FEC element described above may be manufactured by a rotary oblique deposition process developed by Spindt, which is disclosed in U.S. Pat. No. 3,789,471. Also, the FEC element may be manufactured by subjecting a silicon single-crystal plate to selective etching. The former method exhibits an advantage of permitting a cathode tip material to be freely selected as desired and the latter method has an advantage of permitting current semiconductor fine processing techniques to be applied thereto without modifying the techniques.

Now, a conventional FEC manufactured according to the Spindt process will be described with reference to FIGS. 33(*a*) and 33(*b*).

An FEC shown in FIG. 33(*a*) is formed by first depositedly forming a conductive layer 100 of a thin film for a cathode electrode on an insulating substrate 100 made of glass or the like and then forming a film of silicon (Si) doped with impurities on the conductive layer 101 to form a resistive layer 102. Then, a gate electrode layer 104 is depositedly formed of niobium (Nb) on the resistive layer 102 through an insulating layer 103 made of silicon dioxide ($SiO_2$) and then holes 114 are formed through the insulating layer 103 and gate electrode layer 104 to expose a part of the resistive layer 102. Thereafter, molybdenum (Mo) or the like for emitters is positively deposited on an exposed surface of the resistive layer 102, to thereby form emitters 115 of a conical shape.

Thus, the Spindt process permits a distance between the conical emitters 115 and the gate electrode layer 104 to be less than a micron, so that emission of electrons from the emitters 115 may be accomplished by merely applying a voltage as low as tens of volts between the emitters 115 and the gate electrode layer 104.

An FEC shown in FIG. 33(*b*) is formed into a so-called triode structure. More particularly, a second gate electrode layer 108 is laminatedly formed on a gate electrode layer 104 through an insulating layer 107. The second gate electrode layer 108 functions to focus electrons emitted from emitters 115. The remaining part of the FEC may be constructed in substantially the same manner as that shown in FIG. 33(*a*).

The FEC elements constructed as shown in FIGS. 33(*a*) and 33(*b*) each may be used for constructing a display device. For example, FIG. 34 shows a display device having the FEC element shown in FIG. 33(*b*) incorporated therein by way of example. More particularly, the display device of FIG. 34 is so constructed that an anode substrate 116 having phosphors deposited thereon is arranged above the insulating substrate 100 having a plurality of the FEC elements formed thereon in an array-like manner, wherein a control voltage $V_{G1}$ is applied to the first gate electrode 104, a voltage $V_{G2}$ for focusing electrons emitted is applied to the second gate electrode 108, and an anode voltage $V_A$ is applied to the anode substrate 116, resulting in the phosphors deposited on the anode substrate 116 being selectively excited for luminescence by electrons emitted from emitters 115.

Now, a drive mechanism for the display device constructed as described above using the FEC elements will be described hereinafter with reference to FIG. 35.

The drive mechanism, as shown in FIG. 35, includes a display controller 120, a cathode-side driver 121, a gate-side driver 122 and a display region 123 constructed in such a manner as shown in FIG. 34 and having image cells of nxm in number. The display controller 120 feeds the cathode-side driver 121 with a vertical scan timing, so that the driver 121 applies a scan voltage to cathodes $C_1$ to $C_n$ in order. Also, the gate-side driver 122 applies a data voltage to gates $G_1$ to $G_m$ depending on display data.

In the drive mechanism thus constructed, image cells (FECs) in a cathode line being scanned each emit electrons toward an anode electrode depending on a gate voltage applied in correspondence to the display data, to thereby permit display desired to be carried out. However, the display region 113 fails to operate under the conditions that a voltage of a TTL level (about 5 V) is applied. In other words, application of a voltage of a level as output from the display controller 120 fails to permit the display region 123 to exhibit display.

In view of the above, the cathode-side driver 121 and gate-side driver 122 each are provided with a voltage level conversion section for converting a voltage of a TTL level into an FEC operation voltage. This requires to arrange the voltage level conversion sections of nxm in number in correspondence to the cathodes $C_1$ to $C_n$ and gates $G_1$ to $G_m$. Also, the cathode-side driver 121 and gate-side driver 122 each are required to be constructed as a unit independent from the display region 123.

Thus, in the display device having the FEC elements incorporated therein which is constructed as described above, the cathode-side driver 121 and gate-side driver 122 must be constructed into units independent from each other, respectively, to thereby cause large-sizing of the display device and an increase in manufacturing cost. Also, the conventional display device requires voltage level conversion sections of nxm in number, so that a circuit of the display device is highly complicated.

Such a display device is normally provided with a data holding circuit or memory circuit for every image cell, so that data stored in the circuit are applied in the form of a control voltage to the gate electrodes. Such construction permits static display to be carried out at a substantially reduced drive voltage while exhibiting increased luminance, as compared with dynamic display. Thus, the display device is effective and suitable for static display. In particular, in view of the fact that in such a display using FEC elements, an increase in luminance requires an increased voltage, so that static display is highly desirable.

Conventionally, in order to provide each of image cells of the display device with a memory function, a thin film transistor type liquid crystal display (TFT-LCD) device and a plasma display (PDP) device have been conventionally known in the art. In the above-described display device having the FECs incorporated therein, it would be considered that a combination of the TFT systems provides each of the image cells with the memory function. Unfortunately, this renders a manufacturing process of the display device extensively complicated to a degree sufficient to render the manufacturing substantially impossible.

Also, when it is desired to provide the display with gradation in the display device using the FECs, it would be considered that image data are fed to the device while being subject to pulse width modulation (PWM) and gradated display required is carried out by controlling a period during which luminescence is carried out. However, this likewise results in construction of the display device being highly complicated.

SUMMARY OF THE INVENTION

The present invention has been made in view of the foregoing disadvantage of the prior art.

Accordingly, it is an object of the present invention to provide a field emission type display device having field emission cathode elements incorporated therein which is capable of providing each of image cells of a display region including FEC elements with a memory function, to thereby provide display with gradation.

It is another object of the present invention to provide a field emission type display device which is capable of permitting the whole display device to be integrated with a display drive circuit section.

In accordance with the present invention, a field emission type display device having a plurality of field emission cathode elements each including at least cathode electrodes, control electrodes and focus electrodes incorporated therein is provided. The field emission type display device includes image cell sections each including a field emission cathode element which forms one image cell so as to emit electron to an anode electrode and data holding sections each arranged for each of the image cell sections and formed by a field emission cathode element so as to permit electrons to be emitted from the cathode electrodes to the focus electrodes by field emission in response to application of a voltage to the control electrodes. The control electrodes of the field emission cathode element of each of the image cell sections are fed with data held in each of the data holding sections.

In accordance with the present invention, there is provided a field emission type display device having a plurality of field emission cathode elements each including at least cathode electrodes, control electrodes and focus electrodes incorporated therein, which includes image cell sections each including a field emission cathode element which forms one image cell so as to emit electron to an anode electrode, switching element sections each arranged for each of the image cell sections and formed by a field emission cathode element so as to permit electrons to be emitted from the cathode electrodes to the focus electrodes by field emission in response to application of a voltage to the control electrodes, and data holding sections each including a capacitor section having a dielectric interposedly arranged between any two of the cathode electrodes, control electrodes and focus electrodes. The control electrodes of the field emission cathode element of each of the image cell sections are fed with data held in each of the data holding sections.

In a preferred embodiment of the present invention, the data holding sections each include a combination of field emission cathode element arrays.

In a preferred embodiment of the present invention, the capacitor section of each of the data holding sections has a voltage of a level corresponding to gradation of image data.

In accordance with the present invention, there is provided a field emission type display device having a plurality of field emission cathode elements each including at least cathode electrodes, control electrodes and focus electrodes incorporated therein, which includes a display region section including image cell sections of nxm in number arranged in longitudinal and lateral directions. The image cell sections each include a field emission cathode element which forms one image cell so as to emit electron to an anode electrode. The display device also includes a cathode driver and a gate driver for feeding a drive signal to cathode electrodes of n in number and gate electrodes of m in number which permit the display region section to execute display operation, respectively. The cathode driver and gate driver each are constituted by a logic circuit using a field emission cathode element as a switching element.

Further, in accordance with the present invention, a field emission type display device having a plurality of field emission cathode elements each including at least cathode electrodes, control electrodes and focus electrodes incorporated therein is provided. The display device includes image cell sections each including a field emission cathode element which forms one image cell so as to emit electrons to an anode electrode, data holding sections each arranged for each of the image cell sections and formed by a field emission cathode element so as to permit electrons to be emitted from the cathode electrodes to the focus electrodes by field emission in response to application of a voltage to said control electrodes due to feeding of data held therein thereto, a display region section including the image cell sections and data holding sections of nxm in number arranged in longitudinal and lateral directions, and a cathode driver and a gate driver for feeding a drive signal to cathode electrodes of n in number and gate electrodes of m in number which permit the display region section to execute display operation, respectively. The cathode driver and gate driver each are constituted by a logic circuit using a field emission cathode element as a switching element.

In a preferred embodiment of the present invention, the region section and the cathode driver and gate driver are arranged on a single substrate common thereto.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate like parts throughout; wherein:

FIG. 7 is a schematic diagrammatic view showing operation of the display device of FIG. 1;

FIG. 8 is a graphical representation showing second gate current characteristics of a field emission cathode in the display device of FIG. 1;

FIG. 18 is a diagrammatic view showing operation of the display device of FIG. 9;

FIGS. 19(*a*) and 19(*b*) each are a graphical representation showing second gate current characteristics of a field emission cathode in the display device of FIG. 9;

FIGS. 20(*a*), 20(*b*) and 20(*c*) each are a schematic view showing an inverter circuit by a field emission cathode in a third embodiment of a display device according to the present invention;

FIGS. 21(*a*), 21(*b*) and 21(*c*) each are a schematic view showing a NOR circuit by a field emission cathode in a third embodiment of a display device according to the present invention;

FIG. 22 is a schematic view showing a NAND circuit by a field emission cathode in a third embodiment of a display device according to the present invention;

DETAILED DESCRIPTION OF THE PREFERRED EMBODIMENTS

Now, a field emission type display device according to the present invention which has field emission cathode elements incorporated therein will be described hereinafter with reference to FIGS. 1 to 32.

Referring first to FIGS. 1 to 8, a first embodiment of a field emission type display device according to the present invention is illustrated.

Figure 6:
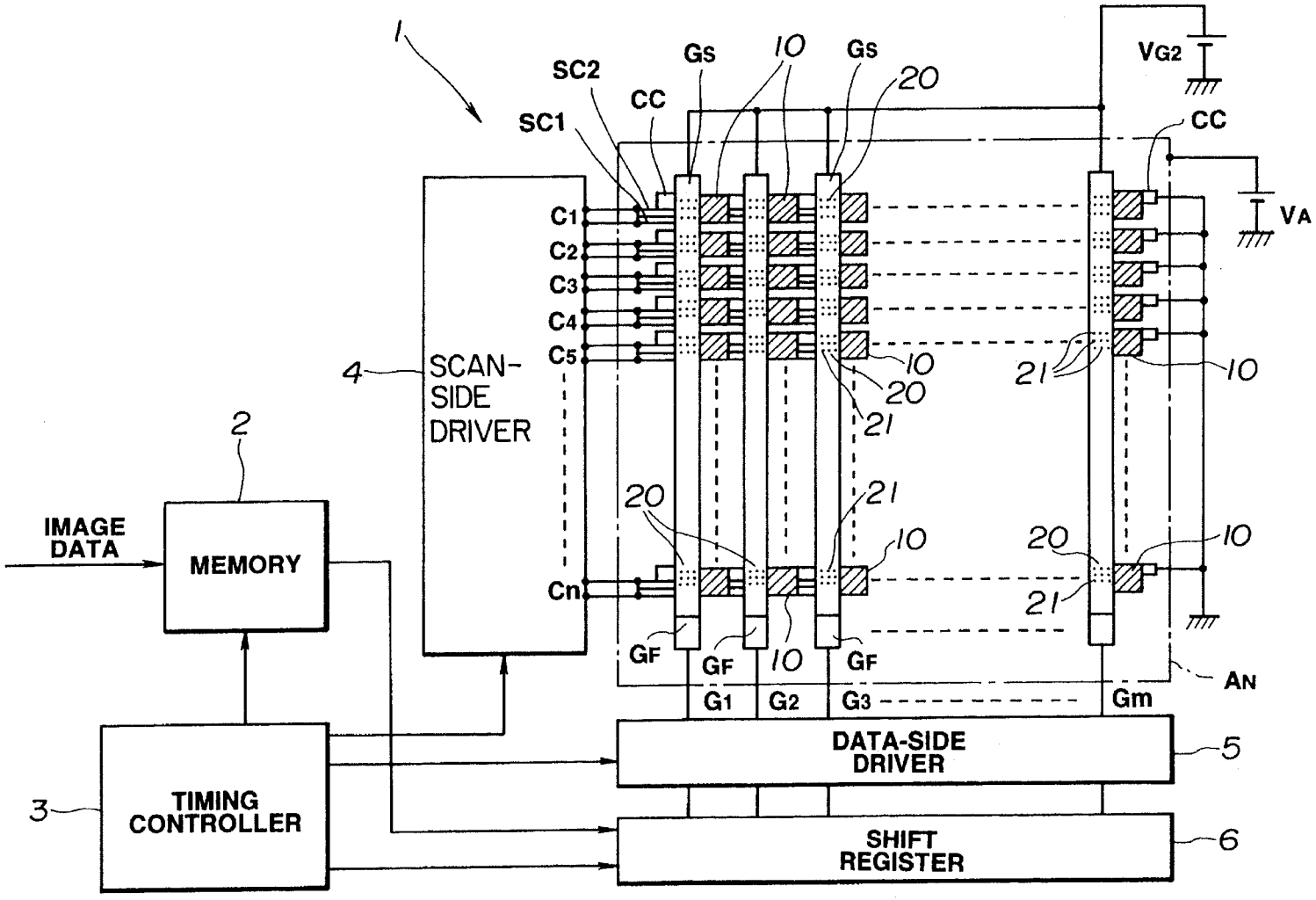
FIG. 6 is a diagrammatic plan view generally showing the display device of FIG. 1.

FIG. 6 generally shows a first embodiment of a field emission type display device according to the present invention. In a display device of the illustrated embodiment generally indicated at reference numeral 1, image data for display fed to a memory 2 are read from the memory 2 while being controlled by a timing controller 3 and then fed to a shift register 6. The shift register 6 feeds image data for one horizontal-direction (lateral-direction) line to a data-side driver 5 depending on a timing signal from the timing controller 3, so that a voltage for one horizontal line based on the image data is applied to gate electrode layers (hereinafter merely referred to as "gate") $G_1$ to $G_m$.

The gates $G_1$ to $G_m$ are so constructed that first gate electrode layers (hereinafter merely referred to as "first gates") $G_F$ each acing as a control electrode and second gate electrode layers (hereinafter merely referred to as "second gates") $G_S$ are superposed on each other through insulating layers, wherein the image data are applied to the first gates $G_F$ and a voltage from a power supply for the second gates is applied to the second gates $G_F$.

The timing controller 3 controls a scan-side driver 4 so that it carries out scan operation in a vertical or longitudinal direction. This results in the scan-side driver 4 applying a scan voltage to cathode electrode layers (hereinafter merely referred to as "cathodes") in order.

The cathodes $C_1$ to $C_n$ each include a common cathode electrode layer (hereinafter merely referred to as "common cathode") CC, a first scan cathode electrode layer (hereinafter merely referred to as "first scan cathode") SC1 and a second scan cathode electrode layer (hereinafter merely referred to as "second scan cathode") SC2. The scan-side driver 4 feeds drive voltages $V_{S1}$ and $V_{S2}$ to the first scan cathode SC1 and second scan cathode SC2 at predetermined timings shown in FIG. 7 for one line scanning, to thereby drive the first scan cathode SC1 and second scan cathode SC2, respectively. The common cathode CC of each of the cathodes $C_1$ to $C_n$ is grounded.

In a display region, the cathodes $C_1$ to $C_n$ each comprising the common cathode CC, first scan cathode SC1 and second scan cathode SC2 are arranged in a horizontal line direction on an insulating substrate such as, for example, a glass substrate and then FEC element array is formed above the cathodes $C_1$ to $C_n$. Above the FEC element array are arranged the first gate $G_F$ and second gate $G_S$ of the gate lines $G_1$ to $G_m$.

This results in the gates G to $G_m$ and cathodes $C_1$ to $C_n$ defining intersections therebetween, at which holes 21 are formed. The holes 21 are formed therein with the above-described FEC element array, so that the FEC element array each constitute one image cell. Thus, the intersections between the gates and the cathodes each are formed thereon with an image cell section 20 defining each image cell.

The display device of the illustrated embodiment also includes an anode electrode plate (hereinafter merely referred to as "anode") $A_N$ arranged above the gates $G_1$ to $G_m$ and cathodes $C_1$ to C as indicated at dashed lines, which is formed thereon with phosphors in correspondence to the image cell sections and has a voltage applied thereto from an anode power supply $V_A$. Thus, when a voltage is selectively applied to each of the first gates $G_F$ based on image data, electrons are emitted from the cathodes $C_1$ to $C_n$ being driven by vertical scanning and therefore the FEC element of each of the image cell sections 20 toward the anode $A_N$, to thereby excite the phosphors of the anode, resulting in desired display being carried out.

Also, the display device 1 of the illustrated embodiment includes memory sections 10 arranged in correspondence to the image cell sections 20 and each functioning as a switching element as indicated at oblique lines in FIG. 6. As described above, driving in each of the image cell sections 20 or application of a voltage to each of the first gates $G_F$ takes place based on data held in each of the memory sections 10. A voltage based on image data which is to be applied to each of the gates $G_1$ to $G_m$ is first fed to each of the memory sections 10 and then applied to the corresponding first gate $G_F$ based on the image data held in the memory section 10.

Thus, desired static display is realized.

Now, the image cell sections 20 and memory sections 10 which constitute an essential part of the display device of the first embodiment will be described hereinafter.

Figure 1:
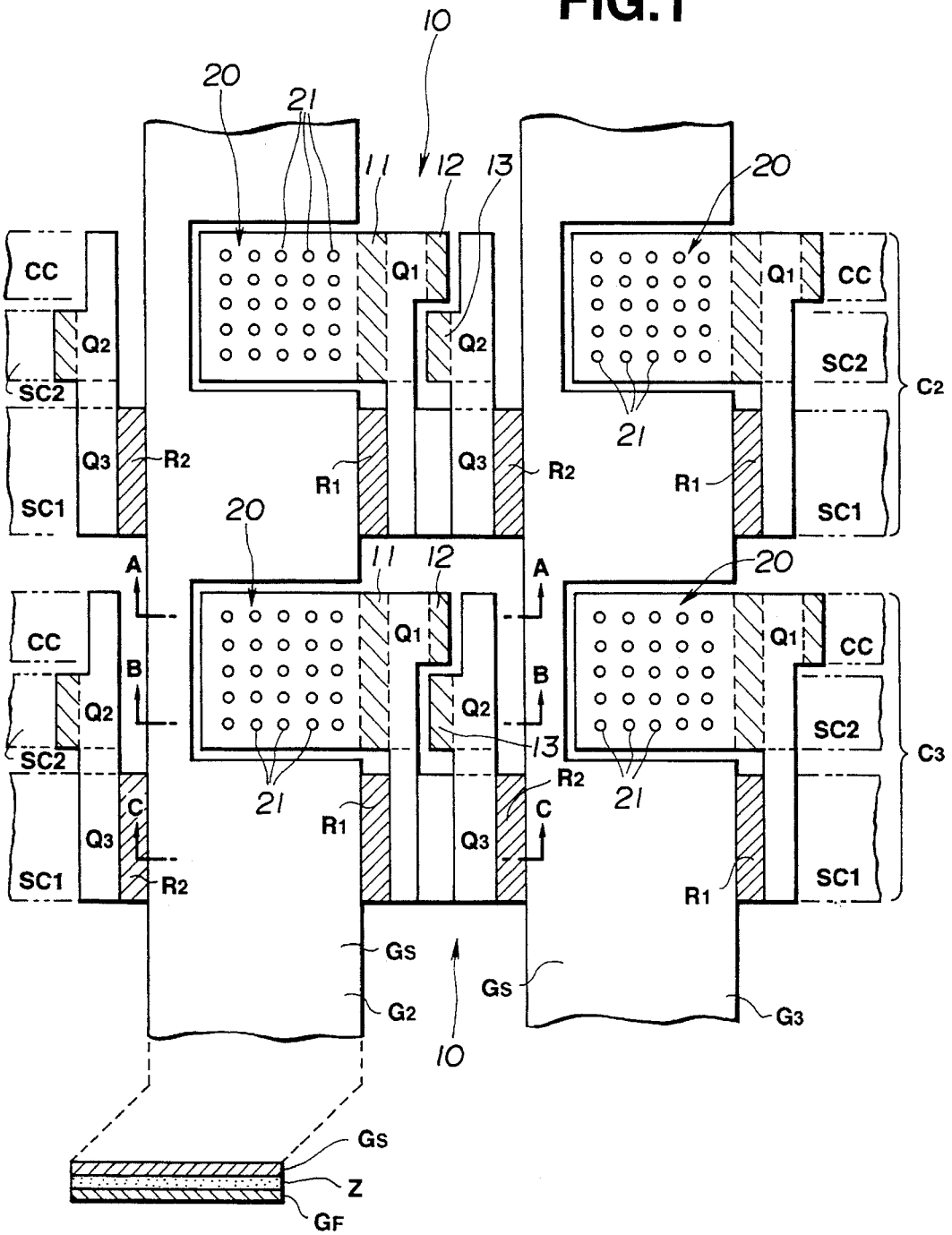
FIG. 1 is a diagrammatic plan view showing an essential part of a first embodiment of a field emission type display device according to the present invention.

FIG. 1 shows image cell sections 20 formed at intersections between the cathodes $C_2$, $C_3$ and the gates $G_2$, $G_3$ and a periphery thereof. The cathodes $C_2$ and $C_3$ which are shown as a lowermost layer in FIG. 1 each include the common cathode CC, second scan cathode SC2 and first scan cathode SC1 arranged in order and the gates $G_2$ and $G_3$ are positioned above the cathodes $C_2$ and $C_3$. The gates $G_2$ and $G_3$ each comprise the first gate $G_F$, an insulator Z and the second gate $G_S$, as described above.

Now, the image cell section 20 formed at an intersection between the cathode $C_3$ and the gate $G_2$ will be described. The second gate $G_S$ of the gate $G_2$ is connected indirectly to the image cell section 20. More particularly, the second gate $G_S$ is connected at a portion thereof constituting an upper side of the memory section 10 to the image cell section 20 through a resistive layer $R_1$, to thereby form an upper surface section. Also, the second gate $G_S$ positioned at a portion of the memory section 10 corresponding to the image cell section 20 is separated at a substantially central portion thereof, so that a right-side section of the second gate $G_S$ in FIG. 1 is connected to the second gate $G_S$ of the gate $G_3$ through a resistive layer $R_2$.

The memory section 10 is formed with an FEC element array in a manner to be positioned below the second gate $G_S$, of which sections are indicated as element sections $Q_1$, $Q_2$ and $Q_3$. In FIG. 1, reference numerals 11, 12 and 13 each designate a conductive layer formed below the second gate $G_S$.

Figure 2:
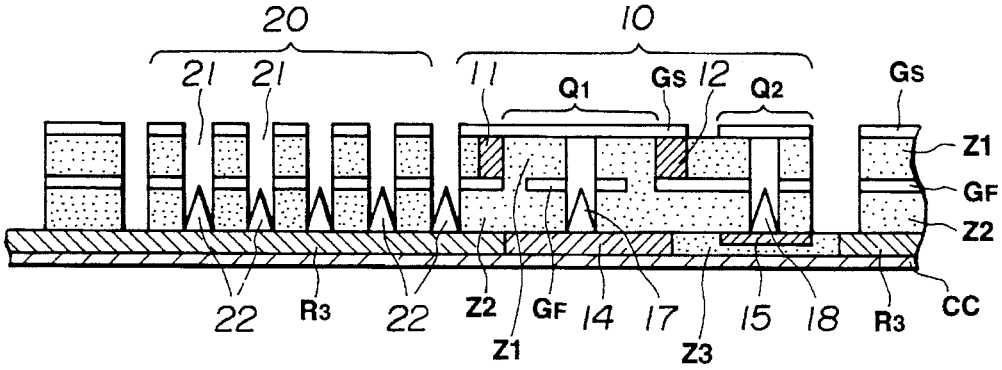
FIG. 2 is an enlarged vertical sectional view taken along line A—A of FIG. 1.
Figure 3:
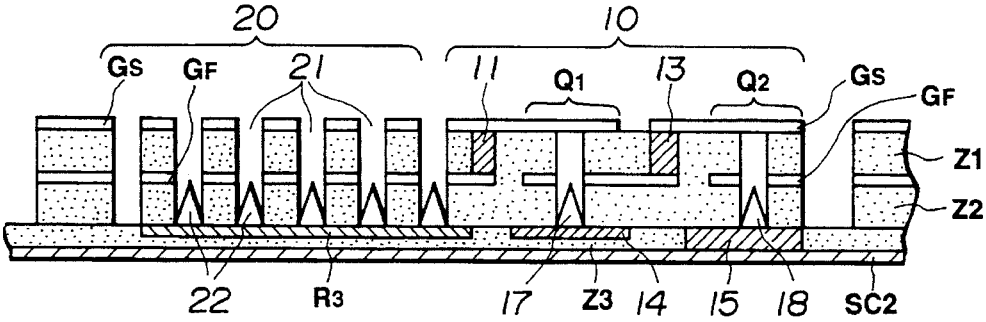
FIG. 3 is an enlarged vertical sectional view taken along line B—B of FIG. 1.
Figure 4:
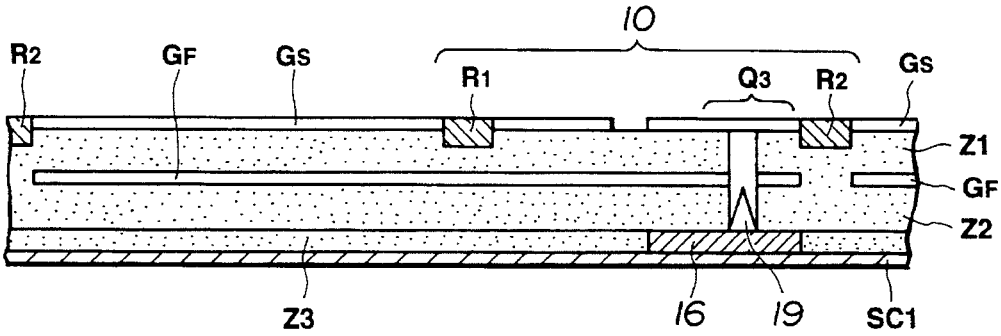
FIG. 4 is an enlarged vertical sectional view taken along line C—C of FIG. 1.

The image cell sections 20 and memory sections 10 may be constructed in such a manner as shown in FIGS. 2 to 4, wherein FIG. 2 is a sectional view taken along line A—A of FIG. 1 showing a portion of the display device above the common cathode CC, FIG. 3 is a sectional view taken along line B—B of FIG. 1 showing a portion of the display device above the second scan cathode SC2, and FIG. 4 is a sectional view taken along line C—C of FIG. 1 showing a portion of the display device above the first scan cathode SC1.

In FIG. 2, the common cathode CC which is shown as a lowermost layer is formed on an upper surface of a portion thereof corresponding to the image cell section 20 with a resistive layer $R_3$ and electrically connected through the resistive layer $R_3$ to emitter cones 22 of the image cell section 20. Thus, in the image cell section 20, the emitter cones 22, first gate $G_F$ and second gate $G_S$ cooperate with each other to form an FEC element on an image cell section side, which emits electrons toward the anode $A_n$. At a portion of the image cell section 20 above the second scan cathode SC2, the resistive layer $R_3$ is insulated from the second scan cathode SC2 by means of an insulating layer 23.

Also, the common cathode CC is formed on a portion thereof corresponding to the element section $Q_1$ of the memory section 10 with a conductive layer 14 and emitter cones 17 in order, so that the emitter cones 17, an insulating layer Z2, the first gate $G_F$, an insulating layer Z1 and the second gate $G_S$ cooperate together to form a first FEC element on an element section side. In this instance, the second gate $G_S$ which is an uppermost layer is formed with no holes because of acting also as a switching element and acts as an anode, so that electrons emitted from the emitter cones 17 reach the second gate $G_S$, to thereby cause a current to flow between the second gate $G_S$ and the common cathode CC in the element section $Q_1$.

Likewise, at a portion of the element section $Q_1$ above the second scan cathode SC2, as shown in FIG. 3, the conductive layer 14 below the emitter cones 17 is insulated from the second scan cathode SC2 by the insulating layer Z3 as shown in FIG. 3 and the second gate $G_S$ in the element section $Q_1$ is electrically connected to the first gate $G_F$ and second gate $G_S$ of the image cell section 20 through the conductive layer 11. Thus, in the image cell section 20, electron emission operation of the emitter cones 17 is limited by a voltage applied to the second gate $G_S$ of the element section $Q_1$.

Further, the common cathode CC is formed on a portion thereof corresponding to the element section $Q_2$ of the memory section 10 with the insulating layer Z3 and the conductive layer 15 on the insulating layer Z3 is formed thereon with emitter cones 18 on a memory section side, so that the emitter cones 18, insulating layer Z2, first gate $G_F$, insulating layer Z1 and second gate $G_S$ cooperate together to form a second FEC element on the memory section side. Also in this instance, the second gate $G_S$ is formed with no holes because of acting also as a switching element and acts as an anode, so that electrons emitted from the emitter cones 18 reach the second gate $G_S$.

In this instance, as shown in FIG. 3, at a portion of the element section $Q_2$ above the second scan cathode SC2, a conductive layer 15 arranged under the emitter cones 18 is connected to the second scan cathode SC2, so that the element section $Q_2$ causes a current to flow between the second gate $G_S$ and the second scan cathode SC2 in the element section $Q_2$.

In addition, above the common cathode CC, as shown in FIG. 2, the second gate $G_S$ of the element section $Q_1$ and the first gate $G_F$ of the element section $Q_2$ are electrically connected to each other through the conductive layer 12. Also, above the second scan cathode SC2, as shown in FIG. 3, the second gate $G_S$ of the element section $Q_2$ and the first gate $G_F$ of the element section $Q_1$ are electrically connected to each other through the conductive layer 13.

As shown in FIG. 4, the insulating layer Z3 is arranged above the first scan cathode SC1 which is shown as a lowermost layer in FIG. 4. Also, the insulating layer Z3 is formed at a portion thereof corresponding to the element section $Q_3$ of the memory section 10 with a conductive layer 16, which is then formed thereon with emitter cones 19 on a memory section side. The emitter cones 19, insulating layer Z2, first gate $G_F$, insulating layer Z1 and second gate $G_S$ cooperate together to provide a third FEC element on the memory section side. Also in this instance, the second gate $G_S$ is formed with no holes because of acting also as a switching element and acts as an anode, so that electrons emitted from the emitter cones 19 reach the second gate $G_S$, to thereby cause a current to flow between the second gate $G_S$ and the first scan cathode SC1 in the element section $Q_3$.

The second gate $G_S$ of the element section $Q_3$ is connected through the resistive layer R2 to the second gate $G_S$ of the adjacent gate line adjacent. As shown in FIG. 1, the right-hand second gate $G_S$ adjacent to the resistive layer $R_1$ is contiguous to the second gate $G_2$ of the element section $Q_1$ shown in FIGS. 2 and 3. Likewise, the left-hand second gate $G_S$ adjacent to the resistive layer $R_2$ or the second gate $G_S$ of the element section $Q_3$ is contiguous to the second gate of the element section $Q_2$ shown in FIGS. 2 and 3.

The first gate $G_F$ of the element section $Q_3$ is formed so as to be contiguous to the gate line ($G_2$) or through the conductive layer thereto, so that image data fed to each of the gates $G_1$ to $G_m$ are applied to the first gate $G_F$ of the element section $Q_3$.

In the first embodiment, the second gate $G_S$ of each of the element sections $Q_1$ to $Q_3$ is formed with no holes. This may be carried out, for example, by forming the second gate $G_S$ with holes and then forming the emitters 17 to 19 thereon, to thereby close the holes of the second gate $G_S$. Such closing of the holes is facilitated by using a mask for oblique deposition or by sputtering or the like.

Figure 5:
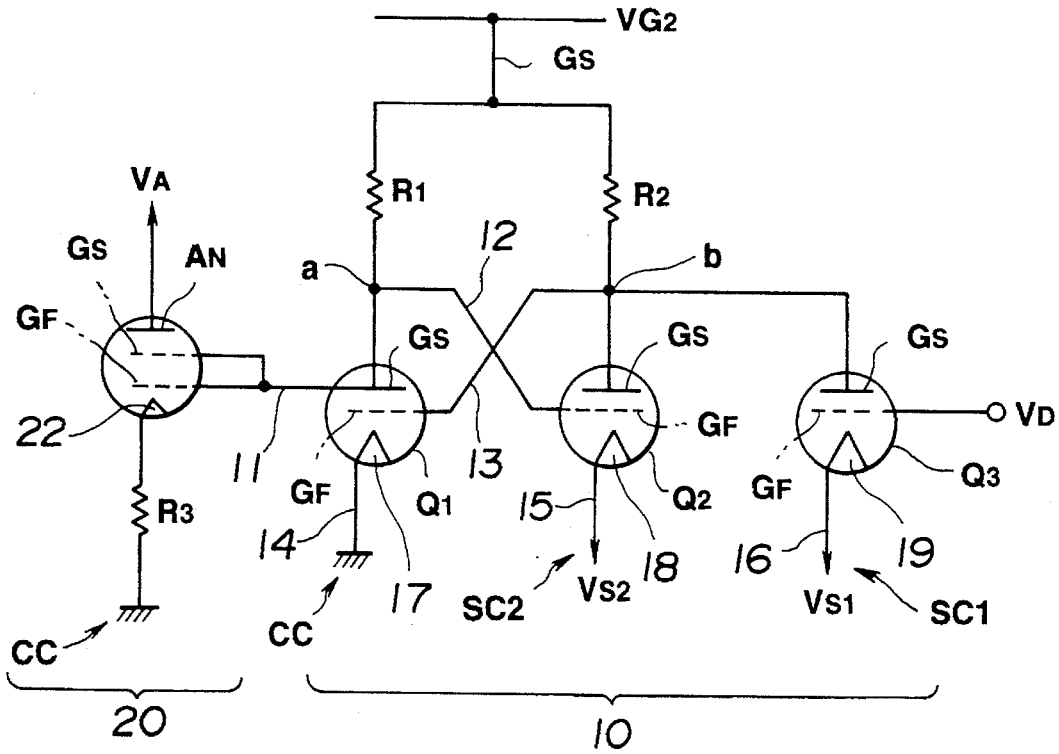
FIG. 5 is a circuit diagram showing an equivalent circuit of an essential part of the display device of FIG. 1.

FIG. 5 shows an equivalent circuit of the image cell section 20 and memory section 10 in the field emission type display device of the first embodiment. The memory section 10 functions to store or hold image data therein by means of a flip flop circuit and the image cell section 20 is driven based on the image data stored or held in the memory section 10.

More particularly, a voltage $V_D$ corresponding to the image data is applied to the first gate $G_F$ of the element section $Q_2$ of the memory section 10, so that when the voltage $V_D$ is higher than a voltage $_{TH}$ shown in FIG. 8, a current is caused to flow from the second gate $G_S$ of the element section $Q_3$ through the emitter cones 19 to the first scan cathode SC1. This results in a voltage drop occurring across the resistive layer $O_2$ to reduce a voltage at a point b (FIG. 5). A decrease in voltage at the point b to a level below the voltage $V_{TH}$ of FIG. 8 prevents a current from flowing between the second gate $G_S$ of the element section $Q_1$ of another memory 10 and the common cathode CC, so that a voltage at a point a may be rendered substantially equal to a second gate voltage $VG_2$, resulting in emission of electrons from the FEC element and therefore luminescence of the anode $A_n$ in the image cell section 20 being carried out.

When the voltage $V_D$ of the first gate $G_F$ in the element section $Q_3$ is lower than the voltage $V_{TH}$ of FIG. 8, the voltage at the point b is rendered substantially equal to the second gate voltage $VG_2$. This causes a current to flow between the second gate $G_S$ of the element section $Q_1$ and the common cathode CC, so that the voltage at the point a is reduced. More particularly, the voltage at the point a is decreased to a level below the voltage $V_{TH}$ of FIG. 8, to thereby prevent emission of electrons from the FEC element in the image cell section 20, resulting in luminescence of the anode $A_n$ being stopped.

Now, a timing of operation of the memory section 10 will be described with reference to FIG. 7.

During scanning for one horizontal line, image data held in the memory section 10 are reset due to an increase in a voltage $V_{S2}$ applied to the second scan cathode SC2. Also, information on the voltage $V_D$ applied to the first gate $G_F$ during a period of from a fall timing of a voltage $V_{S1}$ applied to the first scan cathode SC1 to the next rise timing is held during a period for which the voltage $V_{S1}$ is applied to the first scan cathode SC1. During the period, electrons are emitted from the FEC element of the image cell section 20, leading to luminescence of the anode $A_n$.

As can be seen from the foregoing, in the display device of the illustrated embodiment having the FEC elements incorporated therein, the memory sections 10 are arranged in correspondence to the image cell sections 20, resulting in static display being accomplished. Also, Light emission or luminescence of the anode is carried out depending on data held in the memory section 10, so that a luminous period is increased and adequate luminance is provided at a drive voltage substantially lower than that required for dynamic display. Such a decrease in drive voltage permits durability of the phosphors on a display plane to be improved. Further, the FEC element is incorporated in each of the memory sections in correspondence to incorporation of the FEC element in each of the image cell sections, so that the image cell sections 20 and memory sections 10 may be concurrently manufactured during manufacturing of the FEC elements, to thereby significantly simplify manufacturing of display device.

Also, the first embodiment may be constructed so as to provide a still image by static display when subsequent scanning is not carried out after scanning for one image plane takes place at a voltage based on the image data. In addition, when a pull-up resistor is permitted to exhibit a phase function, it is possible to separate only an image cell obtained when short-circuiting occurs between the cathode and the gate.

In the illustrated first embodiment, the memory sections 10 each have three such FEC elements incorporated therein. Alternatively, it may be constructed that three FEC element array groups each including a plurality of the FEC elements may be provided with such functions as described above.

Referring now to FIGS. 9 to 19, a second embodiment of a field emission type display device having according to the present invention is illustrated.

Figure 17:
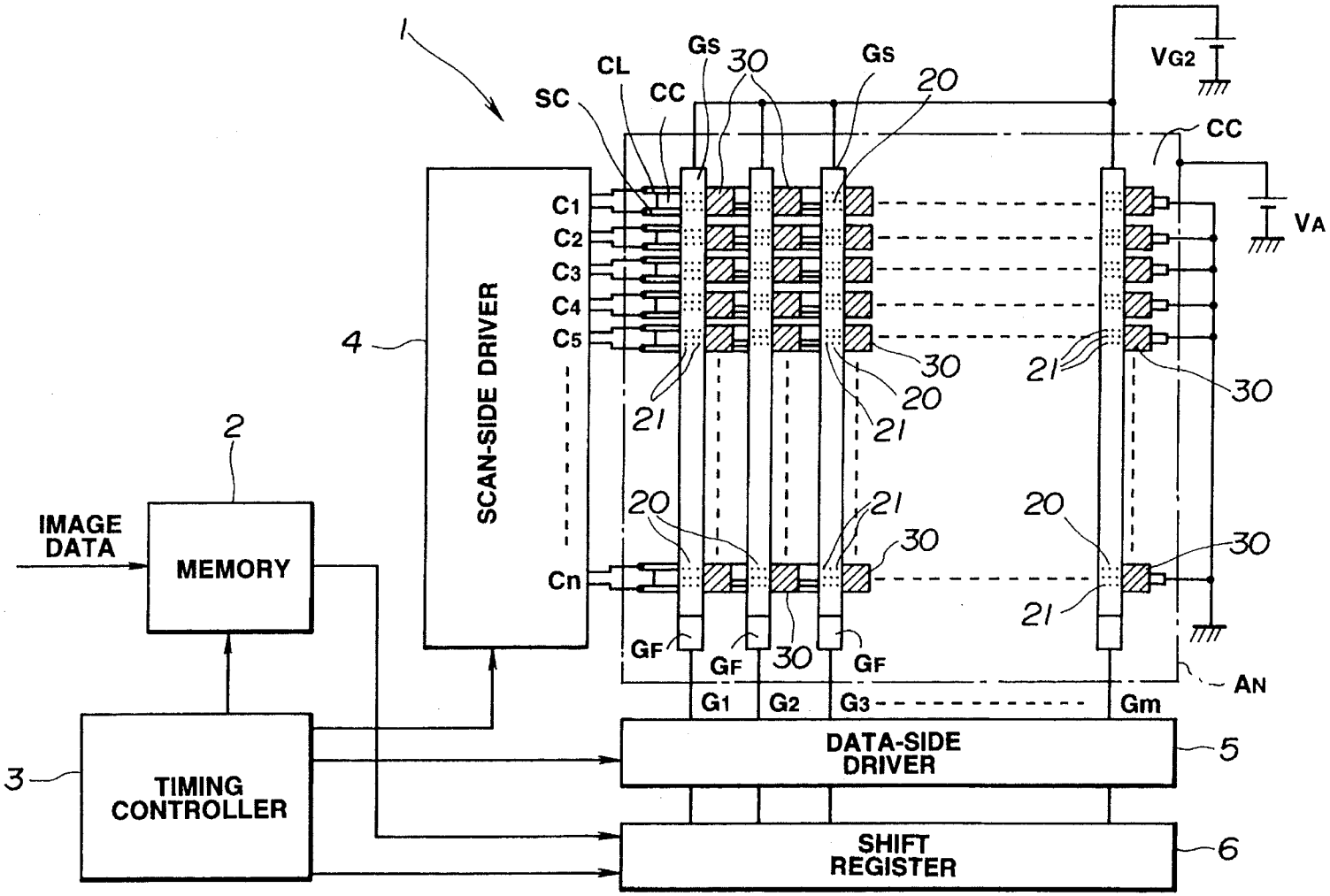
FIG. 17 is a diagrammatic plan view generally showing the display device of FIG. 9.

Essentially, a field emission type display device of the second embodiment designated at reference numeral 1 in FIG. 17 is constructed in substantially the same manner as the above-described first embodiment.

In the first embodiment described above, the common cathode CC, first scan cathode SC1 and second scan cathode SC2 are arranged and the drive voltages $V_{S1}$ and $V_{S2}$ are applied to the first stan cathode SC1 and second scan cathode SC2 at the predetermined timings shown in FIG. 7 for scanning during one horizontal line period, to thereby drive the cathodes SC1 and SC2, respectively. The second embodiment is so constructed that a common cathode CC, a scan cathode SC and a clear electrode CL are arranged and scanning during one horizontal line period is carried out by applying drive voltages $V_S$ and $V_{CL}$ to the scan cathode SC and clear electrode CL at predetermined timings shown in FIG. 18 to drive the electrodes SC and CL, respectively. Also, in the second embodiment, memory sections 30 are provided in correspondence to image cell sections 20, respectively.

Now, the image cell sections 20 and memory sections 30 which constitute an essential part of the display device of the second embodiment will be described with reference to FIGS. 9 to 15.

Figure 9:
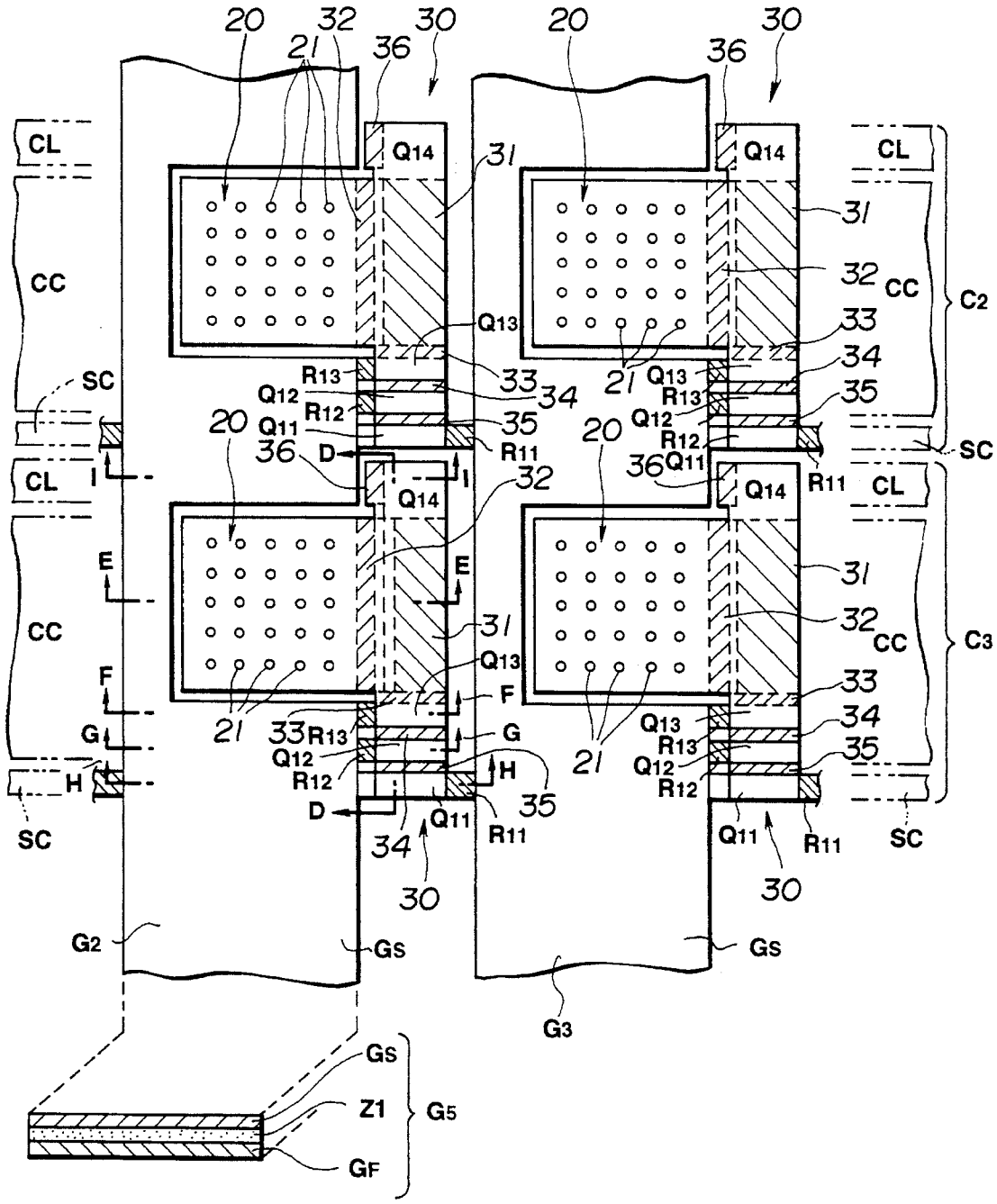
FIG. 9 is a diagrammatic plan view showing an essential part of a second embodiment of a field emission type display device according to the present invention.

FIG. 9 shows the image cell sections 20 formed at intersections between the cathodes $C_2$, $C_3$ and the gates $G_2$, $G_3$ and a periphery thereof.

Each of the cathodes $C_2$ and $C_3$ which are shown as a lowermost layer includes the clear electrode CL, common cathode CC and scan cathode SC arranged in order and the gates $G_2$ and $G_3$ are located on the cathode electrodes $C_2$ and $C_3$ as in the first embodiment described above. The gates $G_2$ and $G_3$ each include a first gate $G_F$, an insulating section Z1 and a second gate $G_S$.

Now, the image cell section 20 will be described. The second gate $G_S$ of the gate $G_2$ is connected indirectly to the image cell section 20. More particularly, the second gate $G_S$ is connected at a portion thereof constituting an upper side of the memory section 30 to the image cell section 20 through resistor sections $R_{12}$ and $R_{13}$, to thereby form an upper surface section. Also, the second gate $G_S$ positioned at a portion of the memory section IO corresponding to the image cell section 20 at an intersection between the cathode $C_3$ and the gate $C_2$ is connected to the second gate $G_S$ of the gate $G_3$ through a resistive section $R_{11}$.

The memory section 30 is formed with FEC arrays in a manner to be positioned below the second gate $G_S$, of which sections are indicated as element sections $Q_{11}$, $Q_{12}$, $Q_{13}$ and $Q_{14}$. The element sections each function as a switching element.

In FIG. 9, reference numeral 31 designates a capacitor section for storing or holding image data therein. The capacitor sections 31 each are formed by interposing a dielectric between the second gate $G_S$ and the cathode. Reference numerals 32 to 36 in FIG. 9 and reference numerals 37 to 39 in FIGS. 10 to 15 each designate a conductive layer formed below the second gate $G_S$. $R_{14}$ is a resistive layer.

The image cell sections 20 and memory sections 30 each may be constructed in such a manner as shown in FIGS. 10 to 15, which are enlarged sectional views taken along lines D—D to I—I in FIG. 9, respectively.

Figure 11:
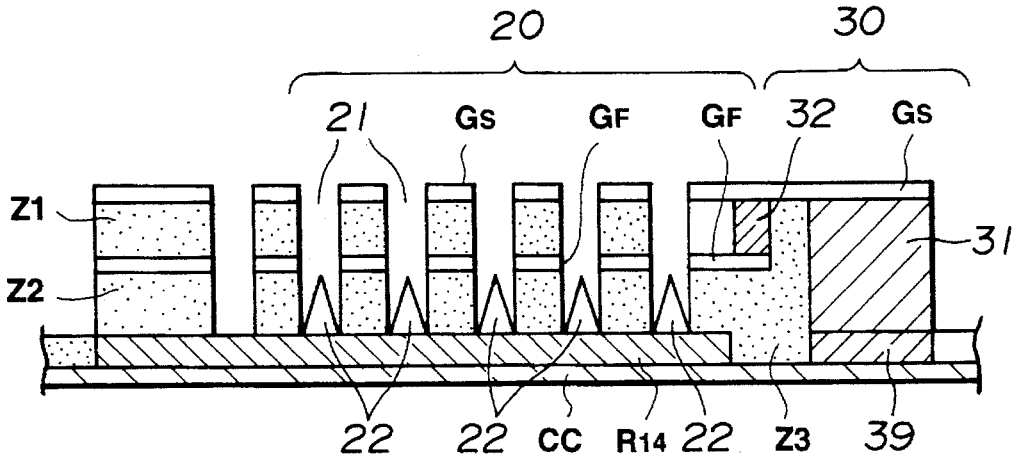
FIG. 11 is an enlarged vertical sectional view taken along line E—E of FIG. 9.

In FIG. 11 which is a sectional view taken along line E—E of FIG. 9, the common cathode CC which is shown as a lowermost layer is formed on an upper surface of a portion thereof corresponding to the image cell section 20 with the above-described resistive layer $R_{14}$ and electrically connected through the resistive layer $R_{14}$ to emitter cones 22 on an image cell section side. Thus, in the image cell section 20, the emitter cones 22, first gate $G_F$ and second gate $G_S$ cooperate with each other to form an FEC element on the image cell section side, which emits electrons toward an anode $A_n$ shown in FIG. 17.

Figure 14:
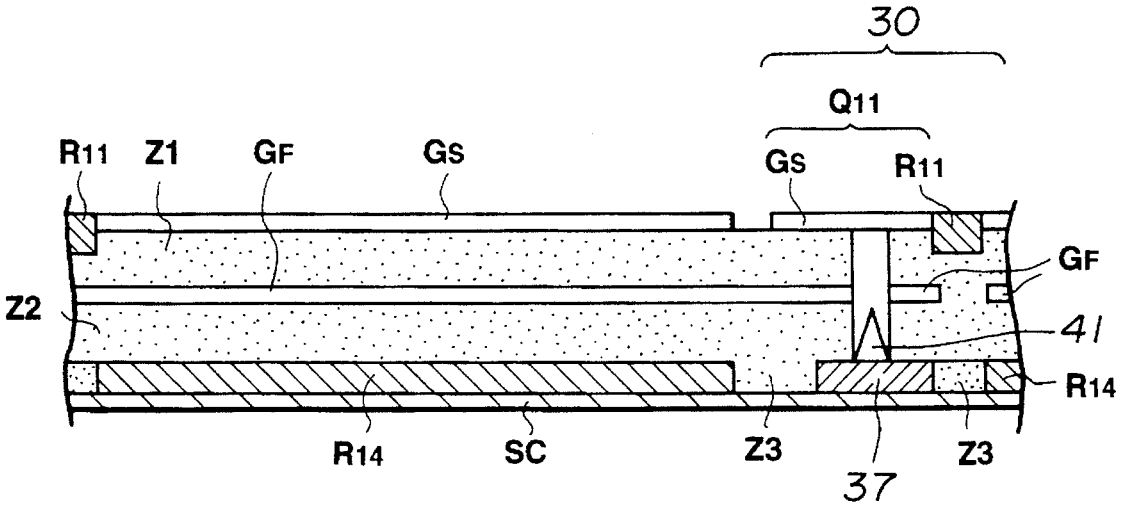
FIG. 14 is an enlarged vertical sectional view taken along line H—H of FIG. 9.

In FIG. 14 which is a sectional view of line H—H of FIG. 9, the scan cathode SC is formed on a portion thereof corresponding to the element section $Q_{11}$ of the memory section 30 with a conductive layer 37 and first emitter cones 41 on a memory section side in order, so that the emitter cones 41, first gate $G_F$ and second gate $G_S$ cooperate together to form an FEC element. In this instance, the second gate $G_S$ is formed with no holes and acts as an anode, so that electrons emitted from the emitter cones 41 impinge on the second gate $G_S$, to thereby cause a current to flow between the second gate $G_S$ and the scan cathode SC.

The second gate $G_S$ of the element section $Q_{11}$ is connected through the resistive layer $R_{11}$ to the second gate $G_S$ of the gate line $G_2$ adjacent thereto. The first gate $G_F$ is connected directly or through a conductive layer to the gate line $G_2$. This results in image data output to the gates $G_1$ to $G_m$ being applied to the first gate $G_F$.

Figure 13:
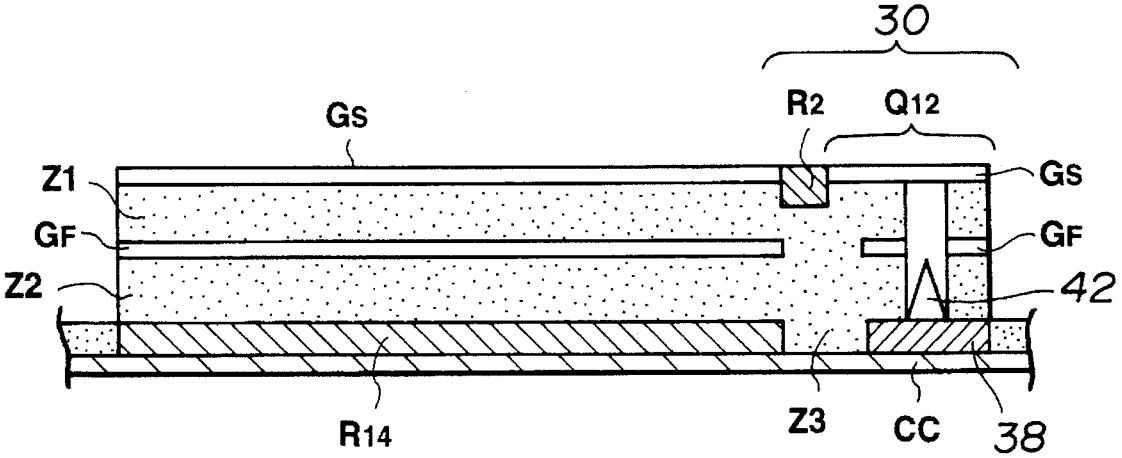
FIG. 13 is an enlarged vertical sectional view taken along line G—G of FIG. 9.

In FIG. 13 which is a sectional view taken along line G—G of FIG. 9, the common cathode CC is formed on an upper surface of a portion thereof corresponding to the element section $Q_{12}$ of the memory section 30 with second emitter cones 42 on the memory section side through a conductive layer 38. The emitter cones 42, first gate $G_F$ and second gate $G_S$ cooperate together to form an FEC element. Also in this instance, the second gate $G_S$ is formed with no holes and acts as an anode, so that electrons emitted from the emitter cones 42 impinge on the second gate $G_S$, to thereby cause a current to flow between the second gate $G_S$ and the common cathode CC.

The second gate $G_S$ of the element section $Q_{12}$ is electrically connected through the resistive layer $R_{12}$ to the second gate $G_S$ of the gate line $G_2$ adjacent thereto.

Figure 12:
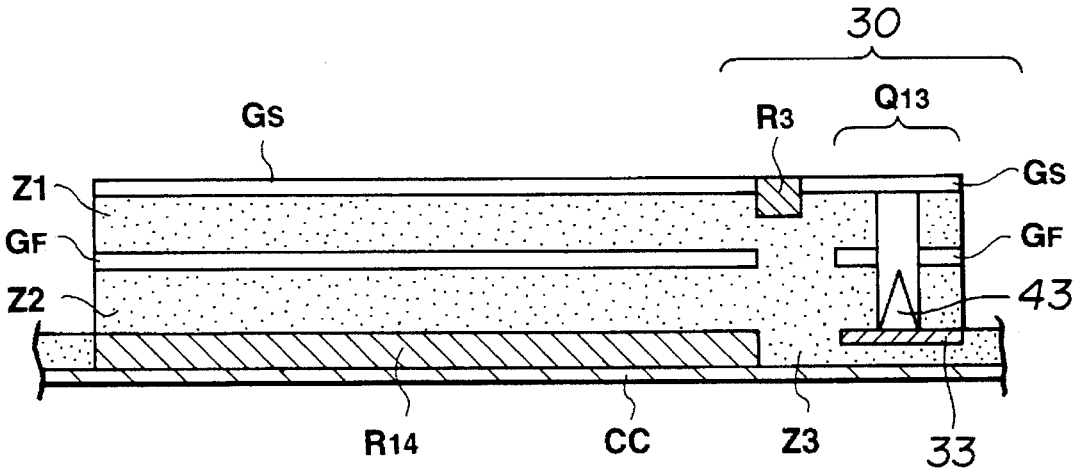
FIG. 12 is an enlarged vertical sectional view taken along line F—F of FIG. 9.

In FIG. 12 which is a sectional view taken along line F—F of FIG. 9, the common cathode CC is formed on an upper surface of a portion thereof corresponding to the element section $Q_{13}$ of the memory section 30 with third emitter cones 43 on the memory section side through an insulating layer Z3 and a conductive layer 33. The emitter cones 43, first gate $G_F$ and second gate $G_S$ cooperate together to form an FEC element. Also in this instance, the second gate $G_S$ is formed with no holes and acts as an anode, so that electrons emitted from the emitter cones 43 impinge on the second gate $G_S$, to thereby cause a current to flow between the second gate $G_S$ and the conductive layer 33. This is applied to only FIG. 12.

The second gate $G_S$ of the element section $Q_{13}$ is electrically connected through the resistive layer $R_{13}$ to the second gate $G_S$ of the gate line $G_2$ adjacent thereto.

Figure 15:
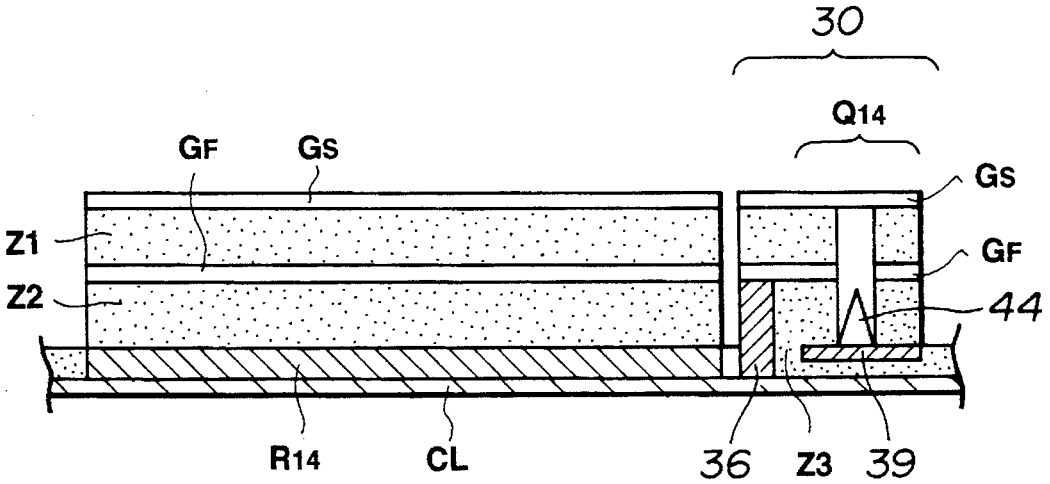
FIG. 15 is an enlarged vertical sectional view taken along line I—I of FIG. 9.

In FIG. 15 which is a sectional view taken along line I—I of FIG. 9, the clear electrode CL is formed on an upper surface of a portion thereof corresponding to the element section $Q_{14}$ of the memory section 30 with fourth emitter cones 44 on the memory section side through the insulating layer Z3 and conductive layer 39. The emitter cones 44, first gate $G_F$ and second gate $G_S$ cooperate together to form an FEC element. The first gate $G_F$ of the element section $Q_{14}$ is electrically connected through the conductive layer 36 to the clear electrode CL, so that application of a voltage to the clear electrode CL controls emission of electrons from the emitter cones 44. Also in this instance, the second gate $G_S$ is formed with no holes and acts as an anode, so that electrons emitted from the emitter cones 44 impinge on the second gate $G_S$, to thereby cause a current to flow between the second gate $G_S$ and the conductive layer 39. This is applied to only FIG. 12.

Figure 10:
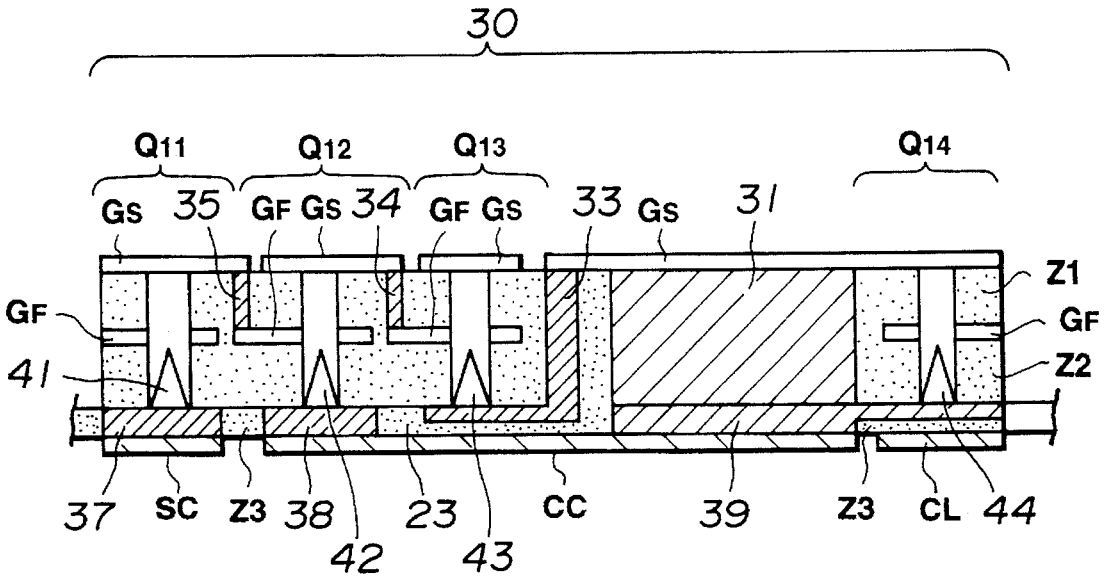
FIG. 10 is an enlarged vertical sectional view taken along line D—D of FIG. 9.

Connection between the element sections $Q_{11}$, $Q_{12}$, $Q_{13}$, $Q_{14}$ and the capacitor section 31 may be carried out as shown in FIG. 10 which is a sectional view taken along line D—D of FIG. 9.

The conductive layer 39 on which the emitter cones 44 of the element section $Q_{14}$ are formed as shown in FIG. 15 forms a part of a conductor on a lower layer side of the capacitor section 31 including a dielectric layer, to thereby be connected to the common cathode CC, so that a voltage applied to the clear electrode CL causes a current to flow between the second gate $G_S$ and the common cathode CC in the essential section $Q_{14}$, as will be understood from FIG. 10.

Likewise, the conductive layer 33 on which the emitter cones 43 of the element section $Q_{13}$ are formed as shown in FIG. 12 is contiguous to the second gate $G_S$ while forming a part of a conductor on an upper layer side of the capacitor section 31 including a dielectric layer, so that electrons emitted from the emitter cones 43 cause a current to flow between the second gate $G_S$ of the element section $Q_{13}$ and the second gate $G_S$ of the capacitor section 31, as will be understood from FIG. 10.

Also, as shown in FIG. 10, the first gate $G_F$ of the element section $Q_{13}$ and the second gate $G_S$ of the element section $O_{12}$ are electrically connected to each other through the conductive layer 34. The first gate $G_F$ of the element section $Q_{12}$ and the second gate $G_S$ of the element section $Q_{11}$ are electrically connected to each other through the conductive layer 35.

In the second embodiment, the second gate $G_S$ of each of the element sections $Q_{11}$ to $Q_{14}$ is formed with no holes as in the first embodiment described above. This may be carried out, for example, by forming the second gate $G_S$ with holes and then forming the emitter cones 41 to 44 thereon, to thereby close the holes of the second gate $G_S$ as in the first embodiment. Such closing of the holes is facilitated by using a mask for oblique deposition or by sputtering or the like.

Figure 16:
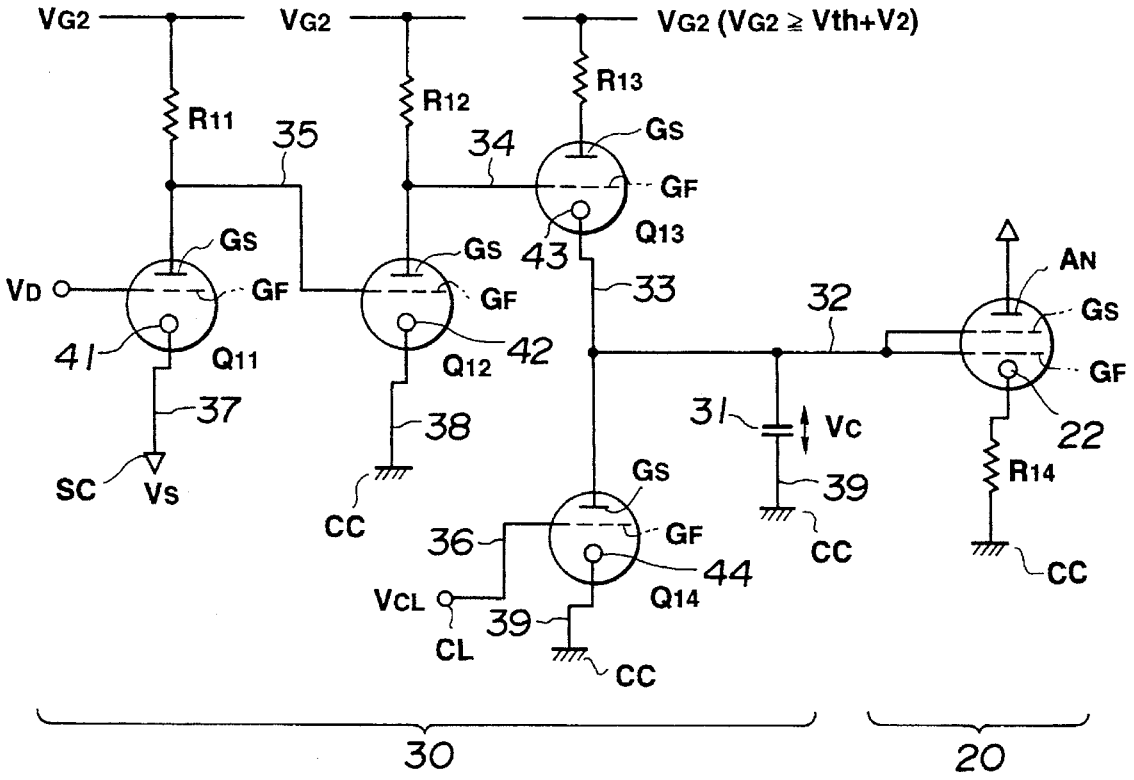
FIG. 16 is a circuit diagram showing an equivalent circuit of an essential part of the display device of FIG. 9.

FIG. 16 shows an equivalent circuit of the image cell section 20 and memory section 30 in the display device of the second embodiment. In the equivalent circuit of FIG. 16, the memory section 30 controls charge and discharge of the capacitor section 31 in association with switching operation of each of the element sections $Q_{11}$ to $Q_{14}$, so that the capacitor section 31 stores or holds image data therein, which are then fed to the image cell section 20 for driving it.

Now, the manner of operation of the memory section 30 will be described with reference to FIGS. 16, 18, 19(*a*) and 19(*b*).

As shown in FIG. 18, a clear voltage $V_{CL}$ higher than a voltage $V_{TH}$ shown in FIG. 19(*a*) is applied from the clear electrode CL to the first gate $G_F$ of the element section $Q_{14}$, so that the emitter cones 44 of the element section $Q_{14}$ are placed under the conditions which permit electrons to be emitted therefrom.

At this time, when the second gate $G_S$ of the element section $Q_{14}$ has a potential sufficient to attract electrons emitted, a current flows from the second gate $G_S$ of the element section $Q_{14}$ to the common cathode CC, so that a potential of the capacitor section 31 is gradually decreased. Then, when the potential is reduced to a level equal to an electron emittable potential $V_1$ of FIG. 19(*a*), the emitter cones 44 of the element section $Q_{14}$ are stopped from emitting electrons and discharge of the capacitor section 31 is prevented. This causes image data stored in the capacitor section 31 to be cleared.

Then, at the next timing, as shown in FIG. 18, a voltage $V_S$ applied to the scan cathode SC is set to be a ground potential or equal to a difference between $V_{G2}$ and $V_{TH}$ or less and a voltage $V_b$ corresponding to image data is applied to the first gate $G_F$ of the gate corresponding thereto at a pulse width (PWM modulated image data) corresponding to luminance of the image data ($V_b \geqq V_{TH}$).

Thus, in this instance, the voltage $V_b$ is applied to the first gate $G_F$ of the element section $Q_{11}$, so that electrons are emitted from the emitter cones 41 of the element section $Q_{11}$ during a period of application of the voltage $V_b$ or an H level period. This results in a current flowing through the resistive layer $R_{11}$, so that a potential of the first gate $G_F$ is decreased corresponding to a voltage drop at the resistive layer, thus, emission of electrons from the element section $Q_{12}$ is stopped. In this instance, during a scan inoperative period or a period for which the scan voltage $V_S$ is kept at a high level, the element sections $Q_{11}$ and $Q_{12}$ are prevented from emitting electrons.

When the element section $Q_{12}$ is stopped from emitting electrons during the scan period or the period for which the scan voltage $V_S$ is kept at a high level, the first gate $G_f$ of the element section $Q_{13}$ is increased in potential, to thereby permit the element section $Q_{13}$ to emit electrons. Also, during the period, the clear voltage $V_{CL}$ is kept from being applied to the first gate $G_F$ of the element section $Q_{14}$, so that the element section $Q_{14}$ is stopped from emitting electrons. Thus, the capacitor section 13 is permitted to be charged during the period for which the element section $Q_{13}$ is placed under electron emitting conditions. Such a charge period is set depending on a pulse width of the voltage $V_b$ corresponding to the image data. Thus, the charging is carried out during the period for which the data voltage $V_b$ is kept at a high level.

Thus, supposing that the data voltage $V_b$ is subject to PWM modulation between a pulse width $W_a$ and the $W_d$ for the purpose of carrying out four-stage gradation display, a charging voltage $V_c$ of the capacitor section 31 is varied between $V_a$ and $V_d$ in correspondence to the pulse width $W_a$ to $W_d$ of the data voltage $V_b$ as shown in FIG. 18.

A hold potential at the capacitor section 31 is caused to be a gate potential at the image cell section 20, so that electrons in amount corresponding to the gate potential are emitted from the emitter cones 22 to the anode $A_N$. This results in an image cell displayed on a plane of the anode $A_N$ exhibiting gradation or luminance corresponding to the hold potential at the capacitor 31.

As described above, in the display device of the second embodiment, the memory sections 20 are provided in correspondence to the image cell sections 20, so that static display may be provided. Also, luminescence is carried out depending on data stored in the memory or the hold potential at the capacitor section 31, so that the luminescence period can be significantly increased, resulting in the static display exhibiting luminance at a drive voltage substantially lower than that required for dynamic display. Further, the second embodiment permits the drive voltage to be decreased, resulting in durability of the phosphors on the display plane being improved. In addition, the PECs are incorporated in each of the memory sections in correspondence to incorporation of the FECs in each of the image cell sections, so that the image cell sections and memory sections can be manufactured concurrently with manufacturing of the FECs, to thereby simplify manufacturing of the display device.

Moreover, when emission of electrons from the FEC element of each of the image cell sections 20 is started based on the hold voltage $V_c$ as shown in FIG. 18, a small amount of current is permitted to flow between the gate of the FET element and the cathode thereof, resulting in discharge from the capacitor section 31 being gradually carried out. When parameters of each of the FEC elements are so set that the discharge is completed within a scan period for one image plane or a period for which the next image data are written in the image cell section 20, a necessity of carrying out memory clearing by the clear electrode CL and element section $Q_4$ can be eliminated, resulting in the clear electrode CL and element section $Q_4$ being eliminated, leading to further simplification of the display device.

In the illustrated second embodiment, the memory sections 30 each have four such FEC elements incorporated therein. Alternatively, it may be constructed that four FEC element array groups each including a plurality of FEC elements constructed as described above may be provided with such functions as described above.

Referring now to FIGS. 20 to 32, third and fourth embodiments of a field emission type display device having field emission cathode elements incorporated therein according to the present invention are illustrated.

First, the third embodiment will be described hereinafter with reference to FIGS. 20 to 31. FIGS. 20(*a*) to 20(*c*) show an inverter circuit using an FEC element as a logic element. The FEC element, as shown in FIG. 20(*a*), includes a cathode C, a resistive layer $R_{22}$ arranged on the cathode C and an emitter cone EC provided on the resistive layer $R_{22}$. The resistive layer $R_{22}$ is provided on a portion thereof free of the emitter cone EC with a first gate $G_F$ through an insulating layer Z, on which a second gate $G_S$ is arranged through an insulating layer Z. In the FEC element constructed as described above, the second gate $G_S$ arranged above the emitter cones EC is not formed with holes through which electrons emitted are guided and acts as an anode for introducing the electrons. The second gate $G_S$ has a second gate voltage $V_{G2}$ applied thereto through a resistive section $R_{21}$, resulting in being pulled up.

The cathode C has a cathode terminal $T_1$ led out thereof and acting as a ground terminal, the first gate $G_F$ includes a first gate terminal $T_2$ lead out thereof and acting as an input terminal, and the second gate $G_S$ has a second gate terminal $T_3$ led out thereof and acting as an output terminal. A voltage input to the first gate terminal $T_2$ has an H level higher than an emission start voltage $V_{TH}$ (FIG. 31) of the emitter cone EC and an L level lower than the voltage $V_{TH}$.

In the FEC element of FIG. 20 constructed as described above, an increase in voltage of the first gate terminal $T_2$ to the H level causes the emitter cone EC to start emission of electrons to the second gate $G_S$. This results in a current flowing from the second gate $G_S$ to the cathode C (ground potential), so that an output voltage of the second gate terminal $T_3$ reaches the L level. When a voltage of the first gate terminal $T_2$ is reduced to the L level, emission of electrons from the emitter cone EC is stopped, to thereby prevent a current form the second gate $G_S$ to the cathode C (ground potential), resulting in an output voltage of the second gate terminal $T_2$ being increased to the H level.

Thus, an inverter circuit shown in FIG. 20(*c*) is formed of the FEC element of FIG. 20(*a*) based on logic of FIG. 20(*b*).

Now, a NOR circuit having an FEC element incorporated therein and acting as a logic element will be described hereinafter with reference to FIGS. 21(*a*), 21(*b*) and 21(*c*).

An FEC element shown in FIG. 21(*a*) comprises a combination of two such FEC elements as described above. wherein a second gate $G_S$ functions as an anode for introducing electrons emitted and has a second gate voltage $V_{G2}$ applied thereto through a resistive section $R_{21}$, to thereby be pulled up.

A cathode C has a cathode terminal $T_4$ led out thereof and acting as a ground terminal, a first gate $G_F$ include first gate terminals $T_5$ and $T_6$ lead out thereof and each acting as an input terminal, and a second gate $G_S$ has a common second gate terminal $T_7$ led out thereof and acting as an output terminal. A voltage input to the first gate terminals $T_5$ and $T_6$ has an H level higher than an emission start voltage $V_{TH}$ (FIG. 31) of each of emitter cones EC and an L level lower than the voltage $V_{TH}$.

In the FEC element of FIG. 21 thus constructed, when a voltage at each of the first gate terminals $T_5$ and $T_6$ reaches the H level, the emitter cones EC each starts to emit electrons to the second gate $G_S$. This causes a current to flow from the second gate $G_S$ to the cathode C (ground), resulting in an output voltage of the second gate terminal $T_7$ being decreased to the L level. When a voltage of any one of the first gate terminals $T_5$ and $T_6$ reaches the H level and that of the other terminal is reduced to the L level, only the emitter cone EC on the H level side is permitted to start emission of electrons to the second gate $G_S$, so that a current is flowed from the second gate $G_S$ to the cathode C (ground), resulting in an output voltage of the second gate terminal $T_7$ being lowered to the L level. When voltages of both first gate terminals $T_5$ and $T_6$ are increased to the L level, both emitter cones EC are stopped from emitting electrons, to thereby prevent a current form flowing from the second gate $G_S$ to the cathode C (ground potential), so that an output voltage of the second gate terminal $T_7$ is increased to the H level.

Thus, the FEC element of FIG. 21(*a*) is formed into the NOR circuit of FIG. 21(*c*) based on logic of FIG. 21(*b*).

FIG. 22 shows a NAND circuit constructed of the above-described FEC element. The NAND circuit can be readily obtained by combining the above-described inverter circuit and NOR circuit as widely known in the art.

Now, a display device of the third embodiment including a logic circuit having the FEC element constructed as described above incorporated therein will be described hereinafter with reference to FIG. 23.

Figure 23:
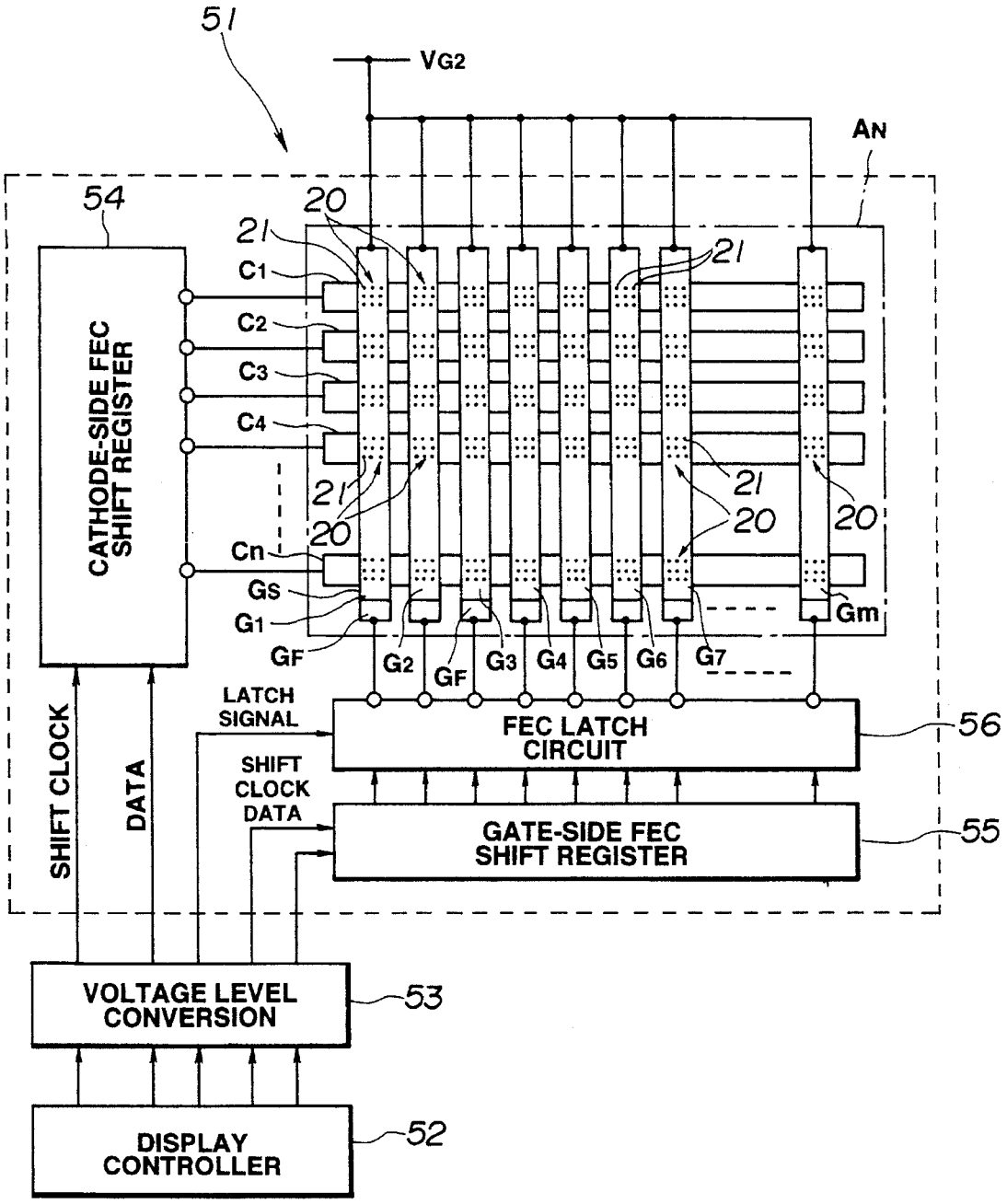
FIG. 23 is a diagrammatic plan view showing a third embodiment of a field emission type display device according to the present invention.

A display device of the third embodiment generally designated at reference numeral 51 in FIG. 23 includes a display controller 52 and a voltage level conversion section 53. Reference numeral 54 designates a cathode-side FEC shift register constructed of a logic circuit having the above-described FEC element incorporated therein, 53 is a gate-side FEC shift register likewise constructed of a logic circuit having the above-described FEC element incorporated therein and 56 is an FEC latch circuit constructed of a logic circuit having the above-described FEC element incorporated therein.

In the display device 51, when image date for display are fed to the display controller 52, the controller 52 feeds scan data and a shift clock to the cathode-side FEC shift register 54 at predetermined timings, feeds image data and a shift clock to the gate-side FEC shift register 55 at predetermined timings and feeds a latch signal to the FEC latch circuit 56 at predetermined timings.

The cathode-side FEC shift register 54, gate-side FEC shift register 55 and FEC latch circuit 56 each are constructed of the logic circuit using the FEC element, so that an operation level (so-called TTL level) of the display controller 52 fails to permit each of the elements 54 to 56 to execute operation thereof. Thus, a signal output from the display controller 52 is converted from the TTL level to an FEC operation level, followed by feeding to the elements.

First, the gate-side FEC shift register 55 is fed with image data for one horizontal line in order from the display controller 55 and then shifted based on a shift clock. When the image data for one horizontal line are held, the data are latched in the FEC latch circuit 56 based on a latch signal, so that a voltage based on the latched data is applied to gate line $G_1$ to first $G_m$. The gates $G_1$ to $G_m$ each are formed by laminating a first gate $G_F$ acting as a control electrode and a second gate $G_S$ acting as a focus electrode on each other through an insulating layer, wherein the image data are fed to the first gate $G_F$ and the second gate $G_S$ has a voltage applied thereto from a second gate power supply $V_{G2}$.

In the cathode-side FEC shift register 54, cathodes $C_1$ to $C_n$ have a scan voltage applied thereto in order so that scan operation in a vertical direction may be carried out based on a signal from the display controller 52.

In a display region, the cathodes $C_1$ to $C_n$ are arranged in a horizontal line on an insulating substrate such as, for example, a glass substrate, above which the above-described FEC element array is arranged. Above the array are arranged the first gates $G_F$ and second gates $G_S$ of the gate lines $G_1$ to $G_m$.

Intersections between the gates $G_1$ to $G_m$ and the cathodes $C_1$ to $C_n$ each are formed with an aperture or hole section 21, in which the FEC element array is arranged. Thus, the FEC element arrays at each of the intersections between the gates $G_1$ to $G_m$ and the cathodes $C_1$ to $C_n$ form one picture cell or each of image cell sections 20.

An anode $A_N$ arranged above the gates $G_1$ to $G_m$ and the cathodes $C_1$ to $C_n$ and indicated by dashed lines in FIG. 23 is formed thereon with phosphors in positional correspondence to the image cell sections 20. Thus, when a voltage is applied to each of the first gates $G_F$ based on the image data, the FEC elements of each of the image cell sections 20 at the intersections between the cathodes and the gates emit electrons, which then impinge on the anode $A_N$ to excite the phosphor, resulting in desired display be carried out.

Further, in the display device 51 of the third embodiment, as described above, the cathode-side FEC shift register 54, gate-side FEC shift register 55 and FEC latch circuit 56 constituting a display drive circuit section each are constructed of the logic circuit having the FEC element incorporated therein, so that the display drive circuit section may be formed on the same plane as the substrate on which the cathodes $C_1$ to $C_n$ and gate $G_1$ to $G_m$ are formed as the display region section. Thus, the third embodiment permits the display region section and display drive circuit section to be formed integrally with each other.

Figure 24:
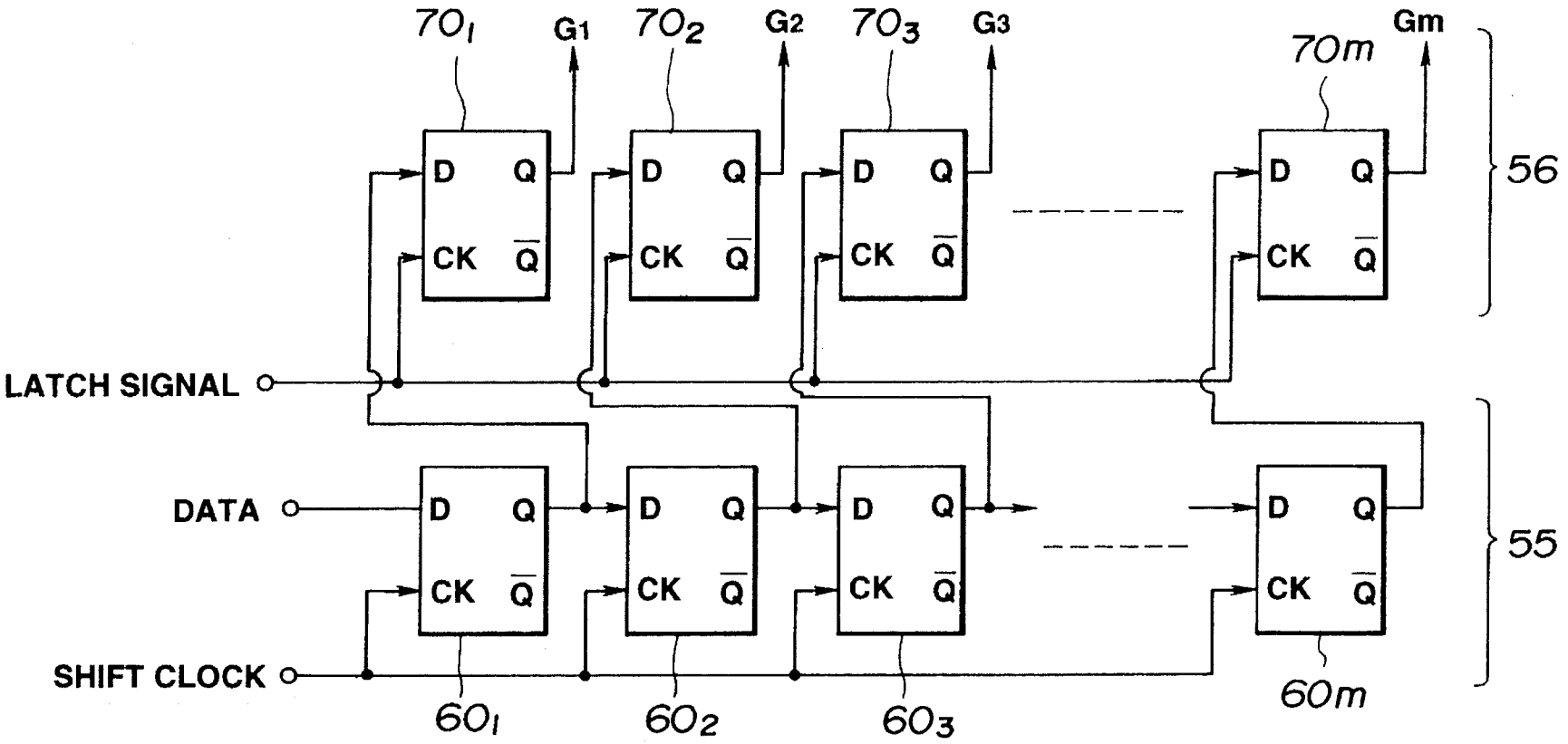
FIG. 24 is a circuit diagram showing a gate driver in the display device of FIG. 23.

Now, the gate-side FEC shift register 55 and FEC latch circuit 56 will be described hereinafter on behalf of the display drive circuit section constructed of the logic circuits each using the FEC element with reference to FIG. 24.

The gate-side FEC shift register 55 includes D flip-flops $\mathbf{60}_1$ to $\mathbf{60}_m$. Thus, in correspondence to the gates $G_1$ to $G_m$, image data are fed in order from a side of the D flip-flop $\mathbf{60}_1$ to that of the D flip-flop $\mathbf{60}_m$ at a timing of a shift lock.

The FEC latch circuit 56 includes D flip-flops $\mathbf{70}_1$ to $\mathbf{70}_m$, wherein a latch signal input thereto at the time when data for one horizontal line are held in the gate-side FEC shift register 55 causes data held in the D flip-flops $\mathbf{60}_1$ to $\mathbf{60}_m$ of the gate-side FEC shift register 55 to be latched by the D flip-flops $\mathbf{70}_1$ to $\mathbf{70}_m$, resulting in the data latched being applied to the gates $G_1$ to $G_m$, respectively.

Figure 25:
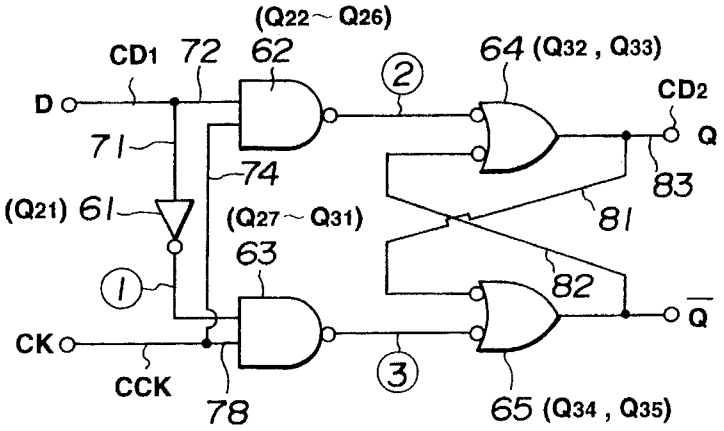
FIG. 25 is a circuit diagram showing a D flip-flop in the gate driver of FIG. 24.
Figure 26:
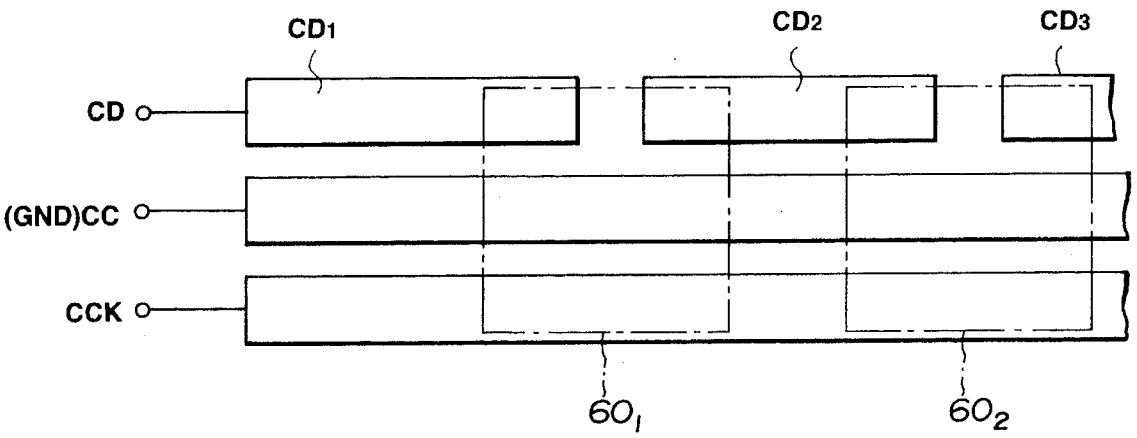
FIG. 26 is a schematic plan view showing the manner of formation of the D flip-flop shown in FIG. 25.

The D flip-flops $\mathbf{60}_1$ to $\mathbf{60}_m$ and $\mathbf{70}_1$ to $\mathbf{70}_m$, as shown in FIG. 25, each basically include an inverter circuit 61, NAND circuits 62 and 63, and NOR circuits 64 and 65. Details of the D flip-flops are as shown in FIGS. 26 to 30.

First, each of the D flip-flops is provided at a portion thereof at which the gate-side FEC shift register 55 is arranged with a data cathode CD for input of image data as a cathode for forming the FEC element for the gate-side FEC shift register 55, a common cathode CC as a ground and a clock cathode CCK for input of a shift clock. Also, it includes an FEC element array arranged on each of the cathodes for forming each of the D flip-flops $\mathbf{60}_1$ to $\mathbf{60}_m$.

The data cathode CD is divided into divisions $CD_1$ to $CD_m$ so that image data fed from the display controller 52 through the voltage level conversion section 53 thereto are the foremost data cathode $CD_1$. Image data shifted from the D flip-flop $\mathbf{60}_1$ are input to a D terminal of the D flip-flop $\mathbf{60}_2$ by the next data cathode $CD_2$. Further, image data shifted from the D flip-flop $\mathbf{60}_2$ are input to a D terminal of the D flip-flop $\mathbf{60}_3$ by the third data cathode $CD_3$. Likewise, image data shifted from the D flip-flop $\mathbf{60}_{m-1}$ are input to a D terminal of the last data cathode $CD_m$.

Figure 27:
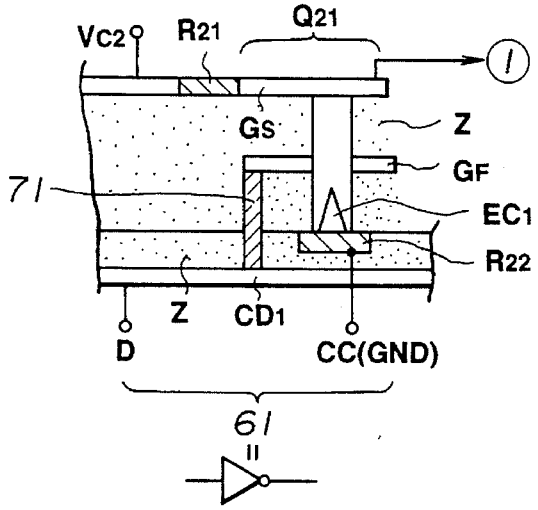
FIG. 27 is a vertical sectional view showing an inverter circuit by a field emission cathode in the D flip-flop of FIG. 25.

FIG. 27 shows the inverter circuit 61 in the D flip-flop $\mathbf{60}_1$ constructed as shown in FIG. 25. The inverter circuit 61 includes a resistive layer $R_{22}$ formed through an insulating layer Z on the data cathode $CD_1$ and an emitter cone $EC_1$ formed on the resistive layer $R_{22}$. The emitter cone $EC_1$, a first gate $G_F$ and a second gate $G_S$ cooperate together to form an FEC element section $Q_{21}$. The second gate $G_S$ has a second gate voltage $V_{G2}$ applied thereto through a resistive layer $R_{21}$ and the resistive layer $R_{22}$ is electrically connected to the common cathode CC.

The first gate $G_F$ acting as an input of the inverter circuit is electrically connected through a conductive layer 71 to the data cathode $CD_1$ and an output (1) is output from the second gate $G_S$. The conductive layer 71 and a line for the output (1) are shown in FIG. 25.

Figure 28:
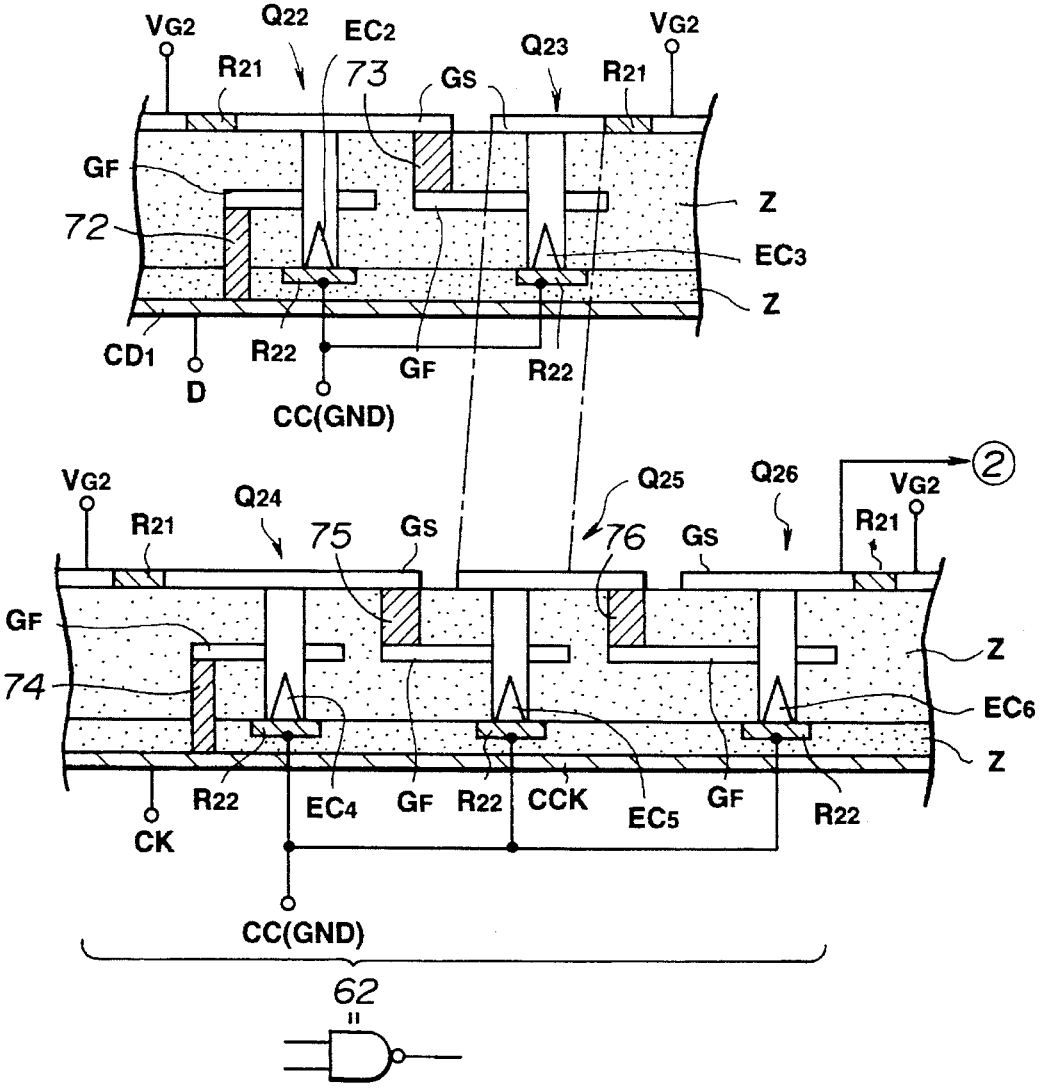
FIG. 28 is a vertical sectional view showing one of NAND circuits by a field emission cathode in the D flip-flop of FIG. 25.

FIG. 28 shows the NAND circuit 62 in the D flip-flop $\mathbf{60}_1$ of FIG. 25. The NAND circuit 62 includes a resistive layer formed through an insulating layer Z on the data cathode $CD_1$ and an emitter cone $EC_2$ formed on the resistive layer $R_{22}$. The emitter cone $EC_2$, a first gate $G_F$ and a second gate $G_S$ cooperate together to form an FEC element section $Q_2$. Likewise, an emitter cone $EC_3$ formed on the resistive layer $R_{22}$, the first gate $G_F$ and second gate $G_S$ constitute an FEC element section $Q_{23}$.

The clock cathode CCK is formed thereon with a resistive layer $R_{22}$ through an insulating layer Z and the resistive layer $R_{22}$ is formed thereon with an emitter cone $EC_4$, so that the emitter cone $EC_4$, a first gate $G_F$ and a second gate $G_S$ form an FEC element section $Q_{24}$. Likewise, the resistive layer $R_{22}$ is formed thereon with an emitter cone $EC_5$, so that the emitter cone $EC_5$, first gate $C_F$ and second gate $G_S$ form an FEC element section $Q_{25}$. Further, the resistive layer $R_{22}$ is formed thereon with an emitter cone $EC_6$, so that the emitter cone $EC_6$, first gate $G_F$ and second gate $G_S$ form an FEC element section $Q_{26}$.

The FEC element sections $Q_{23}$ and $Q_{25}$ are formed with the common second gate $G_S$ extending therebetween. The second gate $G_S$ has a second gate voltage $V_{G2}$ applied thereto through the resistive layer $R_{21}$ and the resistive layer $R_{22}$ is electrically connected to the common cathode CC.

Thus, the FEC element sections $Q_{22}$ to $Q_{26}$ constitute a NAND circuit in which the inverter circuit of FIG. 20 described above and the above-described NOR circuit of FIG. 21 are combined together as shown in FIG. 22. More specifically, the FEC element sections $Q_{22}$, $Q_{24}$ and $Q_{26}$ provide three inverter circuits and the FEC element sections $Q_{23}$ and $Q_{25}$ provide a single NOR circuit.

The first gate $G_F$ of the FEC element section $Q_{22}$ acting as one of inputs of the NAND circuit 60 is electrically connected through a conductive layer 72 to the data cathode $CD_1$, resulting in data being input thereto. The first gate $G_F$ of the FEC element section $Q_{24}$ acting as the other input of the NAND circuit 62 is electrically connected through a conductive layer 74 to the clock cathode CCK, resulting in a shift clock being input thereto. A line for each of the conductive layers 72 and 74 is shown in FIG. 25.

The second gate $G_S$ of the FEC element section $Q_{22}$ and the first gate $G_F$ of the FEC element section $Q_{23}$ are electrically connected to each other through a conductive layer 73, the second gate $G_S$ of the FEC element section $Q_{24}$ and the first gate $G_F$ of the FEC element section $Q_{25}$ are electrically connected to each other through a conductive layer 75, and the second gate $G_S$ of the FEC element section $Q_{25}$ and the first gate $G_F$ of the FEC element section $Q_{26}$ are electrically connected through the conductive layer 75 to each other. The conductive layers 73 to 75 each are a connection line for combination of the invert circuit and NOR circuit.

The second gate $G_S$ of the FEC element section $Q_{26}$ acting as an output of the NAND circuit 62 generates an output (2). A line for the output (2) is shown in FIG. 25.

Figure 29:
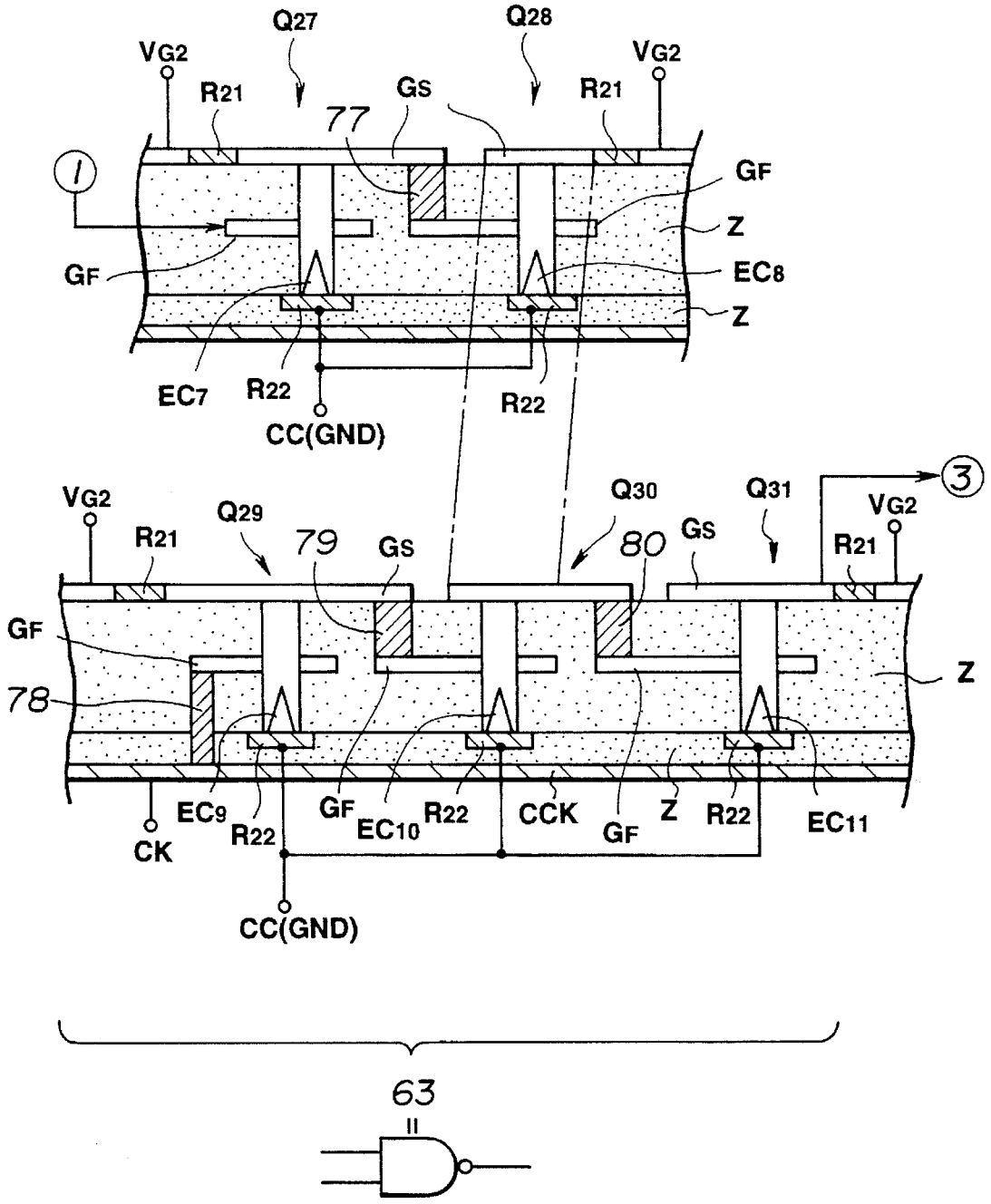
FIG. 29 is a vertical sectional view showing the other NAND circuit in the D flip-flop of FIG. 25.

FIG. 29 shows the NAND circuit 63 in the D flip-flop $\mathbf{60}_1$ constructed as described above with reference to FIG. 25. The NAND circuit 63 includes a resistive layer $R_{22}$ formed through an insulating layer Z on a data cathode such as the data cathode $CD_1$ and an emitter cone $EC_7$ formed on the resistive layer $R_{22}$, so that the emitter cone $EC_7$, a first gate $G_F$ and a second gate $G_S$ cooperate together to form an FEC element section $Q_{27}$. Likewise, the resistive layer $R_{22}$ is formed on an emitter cone $EC_8$, thus, the emitter cone $EC_8$, first gate $G_F$ and second gate $G_S$ form an FEC element section $Q_{28}$.

The clock cathode CCK is formed thereon through an insulating layer Z with a resistive layer $R_{22}$, which is then formed thereon with an emitter cone $EC_9$, so that the emitter cone $EC_9$, a first gate $G_F$ and a second gate $G_S$ form an FEC element section $Q_{29}$. Likewise, the resistive layer $R_{22}$ is formed thereon with an emitter cone $EC_{10}$; thus, the emitter cone $EC_{10}$, first gate $G_F$ and second gate $G_S$ form an FEC element section $Q_{30}$. Further, the resistive layer $R_{22}$ is formed thereon with an emitter cone $EC_{11}$, so that the emitter cone $EC_{11}$, first gate $G_F$ and second gate $G_S$ form an FEC element section $Q_{31}$.

In connection with the FEC element section $Q_{28}$ and $Q_{30}$, the second gate $G_S$ is arranged in a manner to be common to both as indicated at dashed lines in FIG. 29. The second gate $G_S$ has a second gate voltage $V_{G2}$ applied thereto through the resistive layer $R_{21}$ and the resistive layer $R_{22}$ is electrically connected to the common cathode CC.

Thus, the FEC element sections $Q_{27}$ to $Q_{31}$ constitute a NAND circuit in which the inverter circuit of FIG. 20 described above and the above-described NOR circuit of FIG. 21 are combined together as shown in FIG. 22. More specifically, the FEC element sections $Q_{27}$, $Q_{29}$ and $Q_{31}$ provide three inverter circuits and the FEC element sections $Q_{28}$ and $Q_{30}$ provide a single NOR circuit.

The first gate $G_F$ of the FEC element section $Q_{27}$ acting as one of inputs of the NAND circuit 63 is fed with the output (1) of the inverter circuit 61 shown in FIG. 27. The first gate $G_F$ of the FEC element section $Q_{29}$ acting as the other input of the NAND circuit 63 is electrically connected through a conductive layer 78 to the clock cathode CCK, resulting in a shift clock being input thereto. The conductive layer 78 and a line for the output (1) are shown in FIG. 25.

The second gate $G_S$ of the FEC element section $Q_{27}$ and the first gate $G_F$ of the FEC element section $Q_{28}$ are electrically connected to each other through a conductive layer 77, the second gate $G_S$ of the FEC element section $Q_{29}$ and the first gate $G_F$ of the FEC element section $Q_{30}$ are electrically connected to each other through a conductive layer 79, and the second gate $G_S$ of the FEC element section $Q_{30}$ and the first gate $G_F$ of the FEC element section $Q_{31}$ are electrically connected through a conductive layer 80 to each other. The conductive layers 77, 79 and 80 each are a connection line for combination of the invert circuit and NOR circuit.

The second gate $G_S$ of the FEC element section $Q_{31}$ acting as an output of the NAND circuit 63 generates an output (3). A line for the output (3) is shown in FIG. 25.

Figure 30:
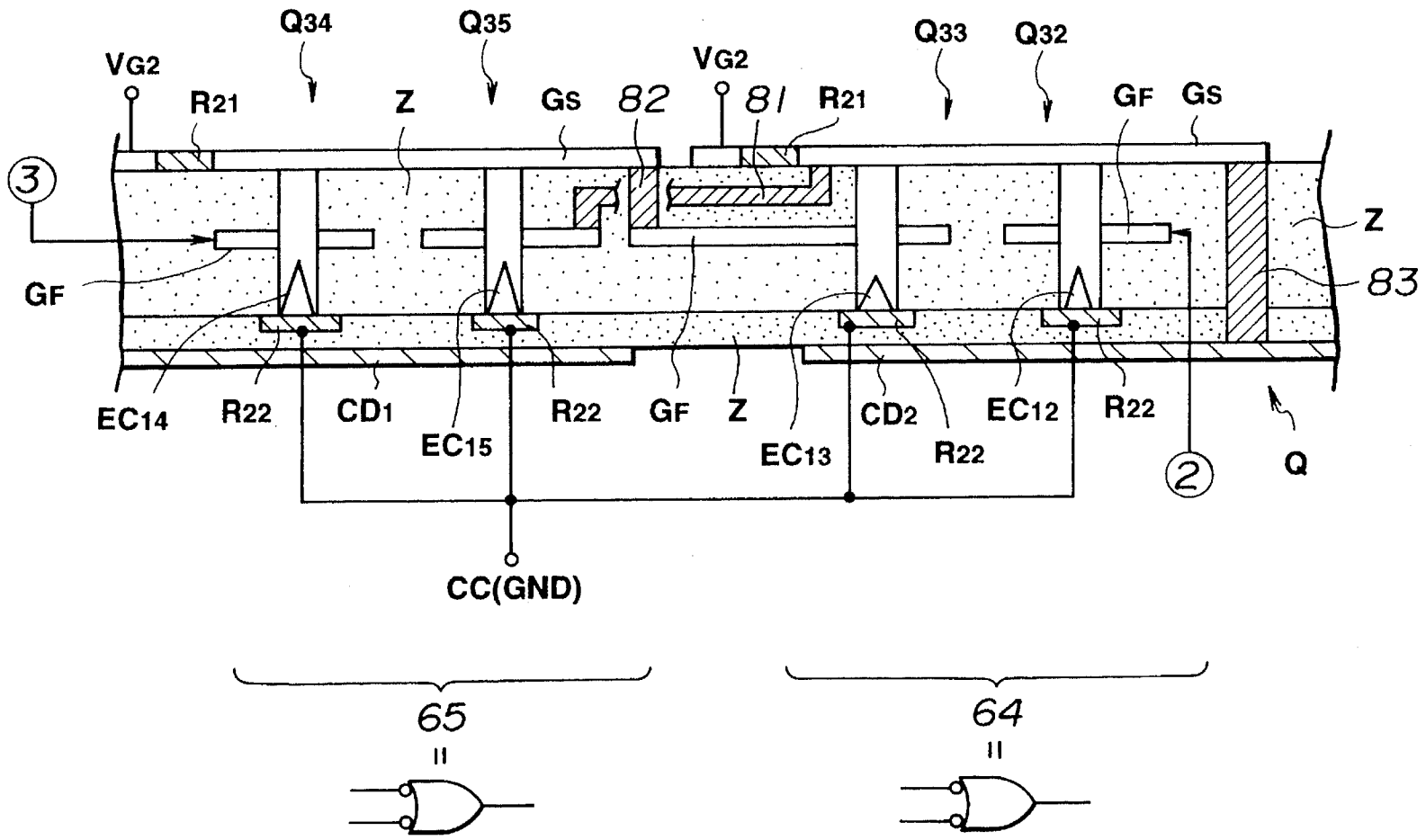
FIG. 30 is a vertical sectional view showing a NOR circuit by a field emission cathode in the D flip-flop of FIG. 25.
Figure 31:
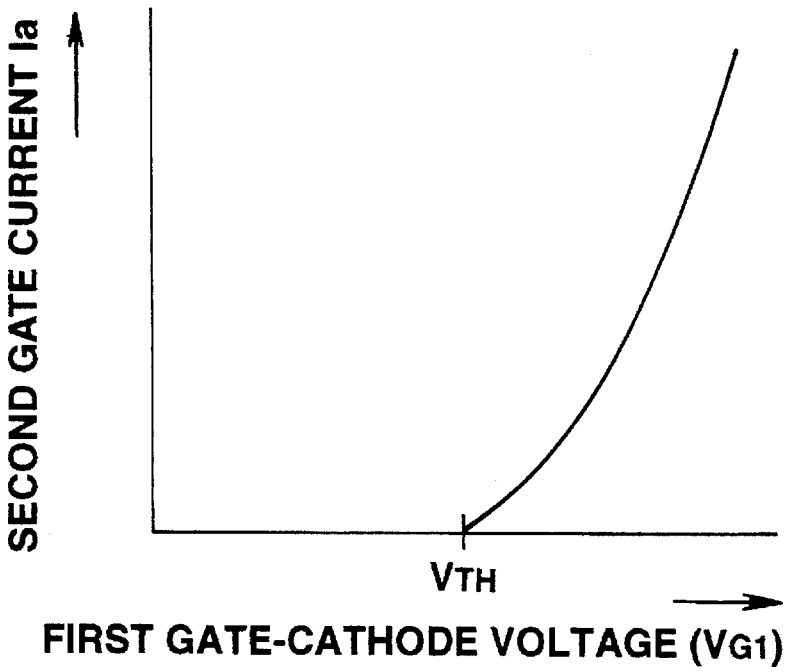
FIG. 31 is a graphical representation showing second gate current characteristics of a field emission cathode in the display device of FIG. 23.

FIG. 30 shows the NOR circuits 64 and 65 in the D flip-flop $\mathbf{60}_1$ constructed as shown in FIG. 25. The NAND circuits 64 and 65 each include a resistive layer $R_{22}$ formed through an insulating layer Z on the data cathode $CD_1$ and an emitter cone $EC_{14}$ formed on the resistive layer $R_{22}$, so that the emitter cone $EC_{14}$, a first gate $G_F$ and a second gate $G_S$ cooperate together to form an FEC element section $Q_{34}$. Likewise, the resistive layer $R_{22}$ is formed on an emitter cone $E_{15}$, thus, the emitter cone $EC_{15}$, first gate $G_F$ and second gate $G_S$ form an FEC element section $Q_{35}$.

The data cathode $CD_2$ is formed thereon through an insulating layer Z with a resistive layer $R_{22}$, which is then formed thereon with an emitter cone $EC_{12}$, so that the emitter cone $EC_{12}$, a first gate $G_F$ and a second gate $G_S$ form an FEC element section $Q_{32}$. Likewise, the resistive layer $R_{22}$ is formed thereon with an emitter cone $EC_{13}$; thus, the emitter cone $EC_{13}$, first gate $G_F$ and second gate $G_S$ form an FEC element section $Q_{33}$.

In connection with the FEC element section $Q_{28}$ and $Q_{30}$, the second gate $G_S$ is common to both. The second gate $G_S$ has a second gate voltage $V_{G2}$ applied thereto through the resistive layer $R_{21}$ and the second gate $G_S$ is also common to the FEC element sections $Q_{32}$ and $Q_{33}$. The second gate $G_S$ also has the second gate voltage $V_{G2}$ applied thereto through the resistive layer $R_{21}$ and the resistive layer $R_{22}$ is electrically connected to the common cathode CC.

Thus, the FEC element sections $Q_{34}$ and $Q_{35}$ constitute the NOR circuit of FIG. 21, resulting in being the NOR circuit 65 of FIG. 25. Likewise, the FEC element sections $Q_{32}$ and $Q_{33}$ constitute the NOR circuit of FIG. 21, resulting in being the NOR circuit 64 of FIG. 25.

The first gate $G_F$ of the FEC element section $Q_{34}$ acting as one of inputs of the NOR circuit 55 is fed with the output (3) of the NAND circuit 63 shown in FIG. 27. The first gate $G_F$ of the FEC element section $Q_{35}$ acting as the other input of the NOR circuit 55 is electrically connected through a conductive layer 81 to the second gate $G_S$ of the FEC element section $Q_{33}$ of the NOR circuit 54, resulting in an output of the NOR circuit 54 being fed thereto. The conductive layer 81 and a line for the output (3) are shown in FIG. 25.

Also, the first gate $G_F$ of the FEC element section $Q_{32}$ acting as one of inputs of the NOR circuit 54 is fed with the output (2) of the NAND circuit 62 shown in FIG. 28. The first gate $G_F$ of the FEC element section $Q_{33}$ acting as the other input of the NOR circuit 54 is electrically connected through a conductive layer 82 to the second gate $G_S$ of the FEC element section $Q_{35}$ of the NOR circuit 55, resulting in an output of the NOR circuit 55 being fed thereto. The conductive layer 82 and a line for the output (2) are shown in FIG. 25.

As will be noted from FIG. 25, an output of the NOR circuit 54 constitutes that of the D flip-flop $\mathbf{60}_1$. For this purpose, the second gate $G_S$ of the NOR circuit 54 is electrically connected through the conductive layer 83 to the data cathode $CD_2$, so that the next D flip-flop $\mathbf{60}_2$ is fed with data.

Likewise, the D flip-flops $\mathbf{60}_2$ to $\mathbf{60}_m$ and $\mathbf{70}_1$ to $\mathbf{70}_m$ each are constructed of the FEC element in substantially the same manner as described above. The cathode-side FEC shift register 54 likewise may be constructed of the logic circuit using the FEC element.

In the field emission type display device of the third embodiment constructed as described above, the cathode-side FEC shift register 54, gate-side shift register 55 and FEC latch circuit 56 each are constructed of the logic circuit using the FEC elements, resulting in being concurrently formed on the substrate on which the display region section is formed in the step of forming the FEC elements for the display region section. Thus, the display region section and display drive circuit section can be concurrently formed, resulting in being integrated with each other.

The third embodiment is so constructed that voltage level conversion between a TTL level or an output level of the display controller 52 and an FEC drive level is executed by means of the voltage level conversion section 53 in an input signal line connected to each of the cathode-side FEC shift register 54, gate-side FEC shift register 55 and FEC latch circuit 56, so that it is merely required to arrange the voltage level conversion sections 53 in correspondence in number to the input lines. Thus, a necessity of arranging the voltage level conversion sections 53 of n×m in number corresponding to the number of cathodes $C_1$ to $C_n$ and gates $G_1$ to $G_m$ can be eliminated.

Thus, it will be noted that the third embodiment readily accomplishes simplification of circuit construction of the whole display device, down-sizing of the display device, simplification of manufacturing of the display device, an improvement in efficiency and the like.

Figure 32:
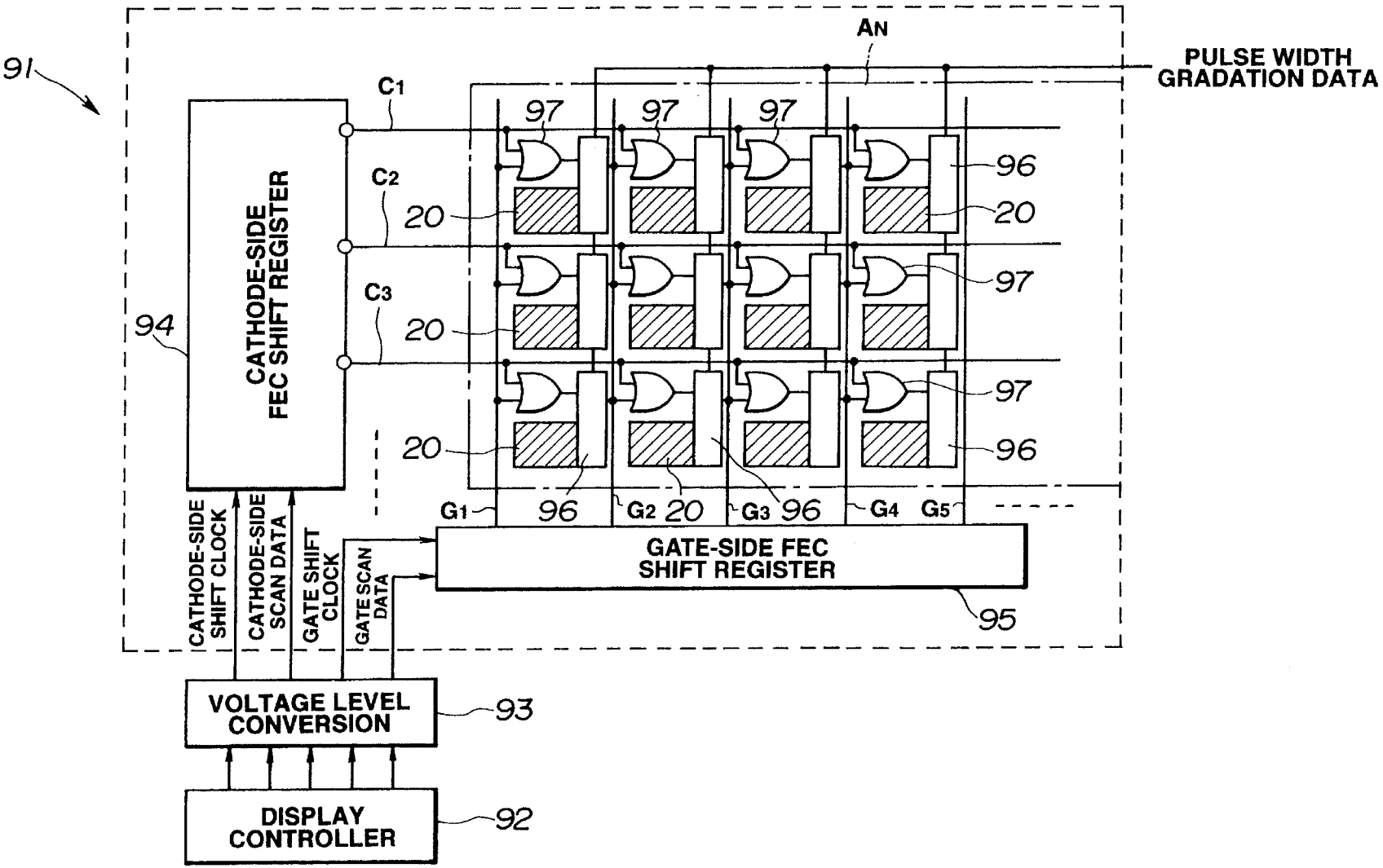
FIG. 32 is a diagrammatic plan view showing a fourth embodiment of a field emission type display device according to the present invention.
Figure 33A:
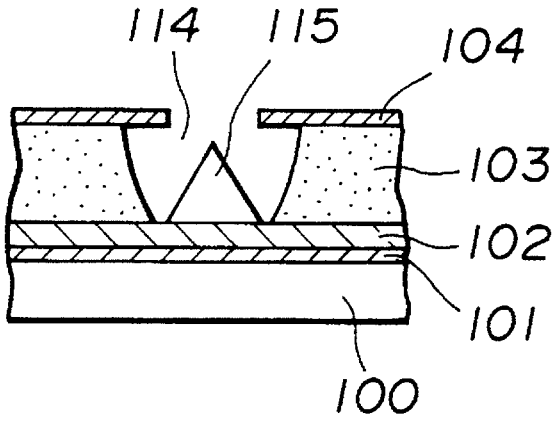
FIGS. 33(*a*) and 33(*b*) each are a fragmentary vertical sectional view showing a field emission cathode array in a conventional display device
Figure 33B:
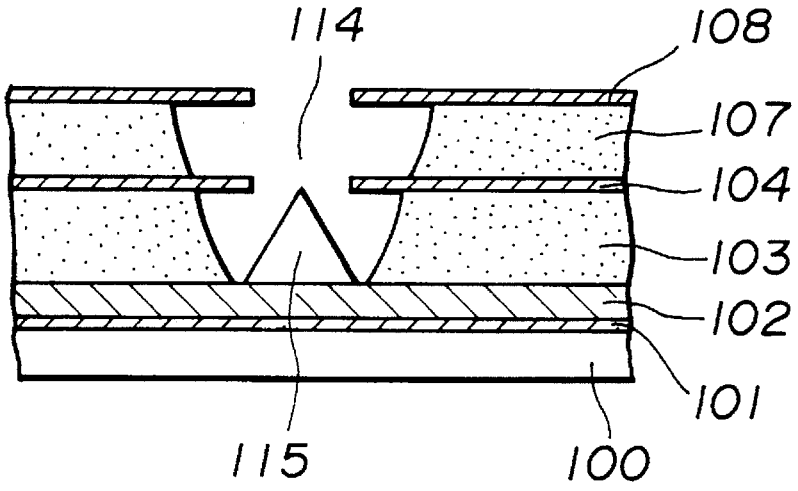
Figure 34:
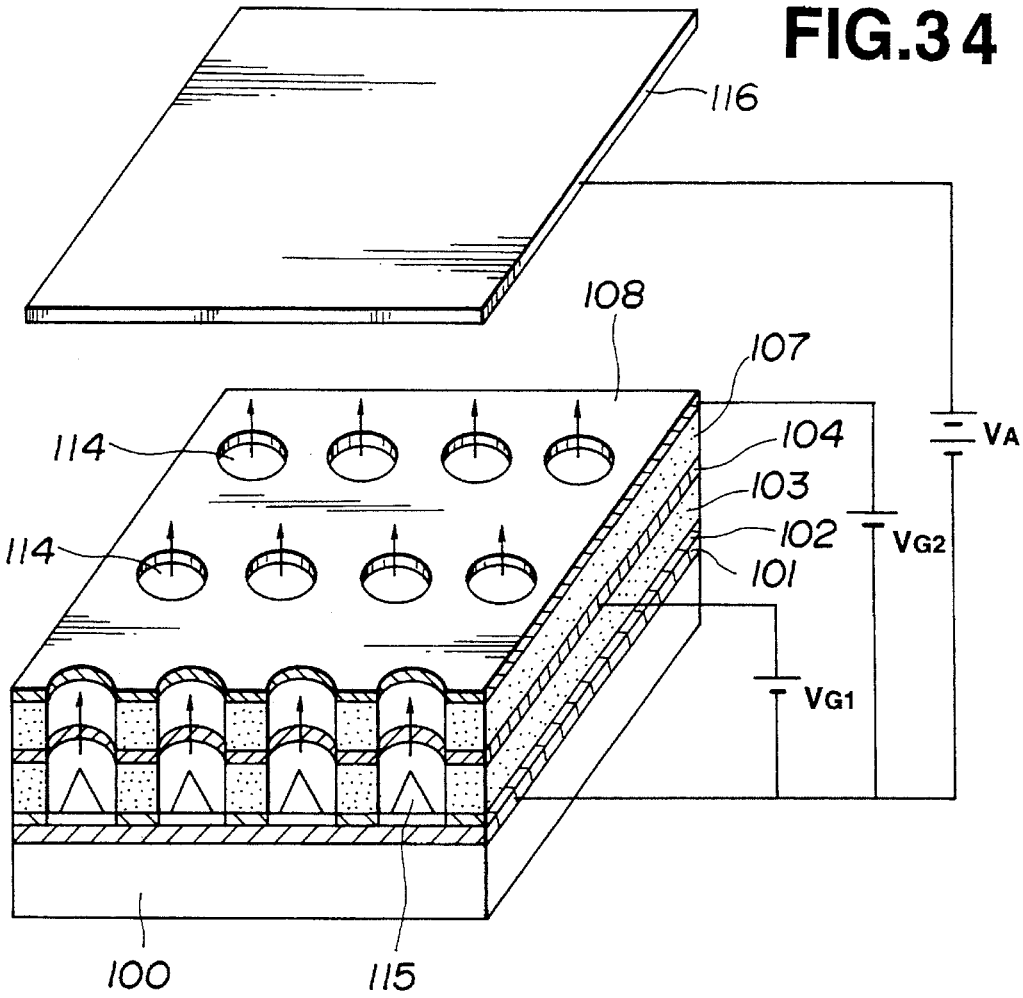
FIG. 34 is a perspective sectional view showing a conventional field emission type display device.
Figure 35:
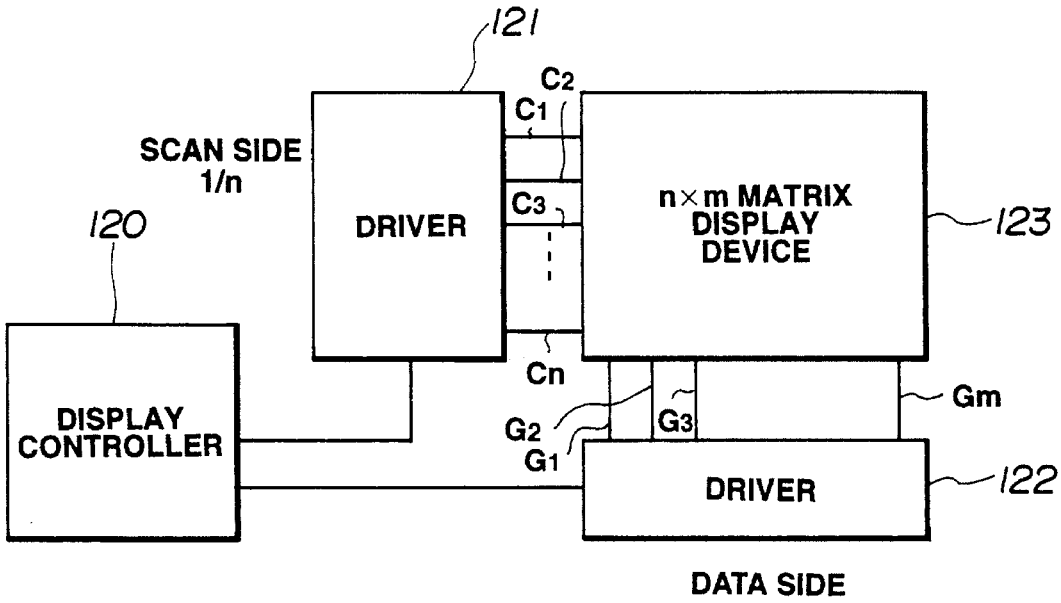
FIG. 35 is a block diagram showing a drive mechanism in a conventional field emission type display device.

Referring now to FIG. 32, a fourth embodiment of a field emission type display device according to the present invention is illustrated. A field emission type display device of the fourth embodiment generally designated at reference numeral 91 likewise includes a cathode-side shift register 94 constructed of a logic circuit using FEC elements and a gate-side FEC shift register 95 likewise constructed of a logic circuit using FEC elements. Also, the display device likewise a voltage level conversion section 93 in an input line between a display controller 92 and each of the elements 94 and 95. However, the fourth embodiment is different from the third embodiment in that a memory section 96 is arranged in correspondence to each of image cell sections 20 in a display region section, to thereby carry out static drive, resulting in eliminating arrangement of a latch circuit for latching data of the gate-side FEC shift register 95 at one horizontal line cycle.

In the fourth embodiment, display drive in the image cell section 20 or application of a drive voltage to a first gate $G_F$ takes place based on data held in the corresponding memory section 96, wherein a voltage (inversion output) based on image data applied to each of gate lines $G_1$ to $G_m$ and scan voltage (inversion output) applied to each cathode lines $C_1$ to $C_n$ are input to an OR circuit 97 provided for every image cell section 20 and the OR circuit 97 selects the image cell section 20 of which the cathode and gate are subject to an inversion level.

Then, PWM-modulated image data (luminance data) are set for the memory 96 corresponding to the image cell section 20 selected. This causes data for gradation display to be set for the memory section 96. Thereafter, data held in the memory 96 are applied to the first gate $G_F$ of the image cell section 20, so that the image cell section 20 emits electrons in amount depending on the gradation toward an anode $A_N$, resulting in desired gradation display being carried out.

Also in the fourth embodiment, the memory section 96 and OR circuit 97 each may be formed of a switching element using FEC elements based on the above-described principle. Thus, the fourth embodiment exhibits the same function and advantage as the third embodiment, as well as the same function and advantage as the first and second embodiments.

While preferred embodiments of the invention have been described with a certain degree f particularity with reference to the drawings, obvious modifications and variations are possible in light of the above teachings. It is therefore to be understood that within the scope of the appended claims, the invention may be practiced otherwise than as specifically described.

What is claimed is:

1. A field emission type display device having a plurality of field emission cathode elements each including at least cathode electrodes, control electrodes and focus electrodes incorporated therein, comprising:

image cell sections each including a first field emission cathode element which forms one image cell so as to emit electron to an anode electrode; and data holding sections each arranged for each of said image cell sections and formed by a second field emission cathode element so as to permit electrons to be emitted from said cathode electrodes to said focus electrodes by field emission in response to application of a voltage to said control electrodes;

said control electrodes of said field emission cathode element of each of said image cell sections being fed with data held in each of said data holding sections.

2. A field emission type display device having a plurality of field emission cathode elements each including at least cathode electrodes, control electrodes and focus electrodes incorporated therein, comprising:

image cell sections each including a field emission cathode element which forms one image cell so as to emit electron to an anode electrode:

switching element sections each arranged for each of said image cell sections and formed by a field emission cathode element so as to permit electrons to be emitted from said cathode electrodes to said focus electrodes by field emission in response to application of a voltage to said control electrodes; and data holding sections each including a capacitor section having a dielectric interposedly arranged between any two of said cathode electrodes, control electrodes and focus electrodes;

said control electrodes of said field emission cathode element of each of said image cell sections being fed with data held in each of said data holding sections.

3. A field emission type display device as defined in claim 1 or 2, wherein said data holding sections each include a combination of field emission cathode element arrays.

4. A field emission type display device as defined in claim 2, wherein said capacitor section of each of said data holding sections has a voltage of a level corresponding to gradation of image data.

5. A field emission type display device having a plurality of field emission cathode elements each including at least cathode electrodes, control electrodes and focus electrodes incorporated therein, comprising:

a display region section including image cell sections of n×m in number arranged in longitudinal and lateral directions;

said image cell sections each including a first field emission cathode element which forms one image cell so as to emit electron to an anode electrode; and a cathode driver and a gate driver for feeding a drive signal to cathode electrodes of n in number and gate electrodes of m in number which permit said display region section to execute display operation, respectively;

said cathode driver and gate driver each being constituted by a logic circuit using a second field emission cathode element as a switching element.

6. A field emission type display device having a plurality of field emission cathode elements each including at least cathode electrodes, control electrodes and focus electrodes incorporated therein, comprising:

image cell sections each including a field emission cathode element which forms one image cell so as to emit electrons to an anode electrode;

data holding sections each arranged for each of said image cell sections and formed by a first field emission cathode element so as to permit electrons to be emitted from said cathode electrodes to said focus electrodes by field emission in response to application of a voltage to said control electrodes due to feeding of data held therein thereto;

a display region section including said image cell sections and data holding sections of n×m in number arranged in longitudinal and lateral directions; and a cathode driver and a gate driver for feeding a drive signal to cathode electrodes of n in number and gate electrodes of m in number which permit said display region section to execute display operation, respectively;

said cathode driver and gate driver each being constituted by a logic circuit using a second field emission cathode element as a switching element.

7. A field emission type display device as defined in claim 5 or 6, wherein said display region section and said cathode driver and gate driver are arranged on a single substrate common thereto.

* * * * *